US005688578A

United States Patent [19]

Goodrich

[11] Patent Number: 5,688,578

[45] Date of Patent: Nov. 18, 1997

[54] COMPOSITE PACKAGING MATERIAL HAVING AN EXPANDED SHEET WITH A SEPARATOR SHEET

[76] Inventor: David P. Goodrich, 14 Ox Hill Rd., Newtown, Conn. 06430

[21] Appl. No.: 385,336

[22] Filed: Feb. 8, 1995

Related U.S. Application Data

[63] Continuation-in-part of Ser. No. 255,062, Jun. 7, 1994, abandoned, and a continuation-in-part of PCT/US94/10209 Sep. 12, 1994, Ser. No. 157,277, Nov. 26, 1993, Pat. No. 5,667,871, and Ser. No. 119,472, Sep. 10, 1993, Pat. No. 5,538,778, said Ser. No. 157,277, Nov. 26, 1993, Pat. No. 5,667,871, and Ser. No. 119,472, Sep. 10, 1993, Pat. No. 5,538,778, each is a continuation-in-part of Ser. No.936,608, Aug. 27, 1992, abandoned, and Ser. No. 962,944, Oct. 19, 1992, abandoned, said Ser. No. 936,608, Aug. 27, 1992, abandoned, and Ser. No. 962,944, Oct. 19, 1992, abandoned, each is a continuation-in-part of Ser. No.851,911, Mar. 16, 1992, abandoned.

[51] Int. Cl.[6] ..... B65D 85/30

[52] U.S. Cl. ..... 428/136; 428/135; 428/137; 428/906; 428/34.2; 428/189; 428/192; 428/194; 428/182; 428/184; 428/167; 428/172; 229/87.02; 493/967; 206/814; 206/521; 206/584; 206/585; 206/586; 206/594

[58] Field of Search ..... 428/135, 136, 428/137, 906, 34.2, 189, 192, 194, 182, 184, 167, 172; 229/87.02; 493/967; 206/814, 521, 584, 585, 586, 594; 29/6.1, 6.2

[56] References Cited

U.S. PATENT DOCUMENTS

| | | | |
|---|---|---|---|
| 1,065,639 | 6/1913 | Thiebuut | 428/182 |
| 1,470,200 | 12/1923 | Snyder | 206/814 |
| 1,940,596 | 12/1933 | Koppelman | 229/87.02 |
| 1,996,402 | 5/1935 | Brauer | 229/87.02 |
| 2,203,084 | 6/1940 | Evans | 229/37 |
| 2,319,225 | 1/1943 | Grechb et al | 154/46 |
| 2,345,844 | 5/1944 | Weiss | 117/98 |
| 2,382,400 | 10/1945 | Decker et al. | 229/87 |
| 2,553,923 | 5/1951 | Lambert | 229/87.02 |
| 3,040,968 | 6/1962 | Long | 229/87 |
| 3,065,785 | 11/1962 | Taber | 160/81 |
| 3,109,579 | 11/1963 | Crane | 229/87 |
| 3,288,353 | 11/1966 | McCullach | 229/87.02 |
| 3,306,513 | 2/1967 | Fishman | 229/15 |
| 3,407,987 | 10/1968 | Wilke | 229/87.02 |
| 3,454,455 | 7/1969 | Rasmussen | 161/112 |
| 3,486,681 | 12/1969 | Radtkedal | 229/87.02 |

(List continued on next page.)

FOREIGN PATENT DOCUMENTS

| | | | |
|---|---|---|---|
| 2033605 | 12/1971 | France . | |
| 225968 | 7/1972 | Germany . | |
| 2158539 | 5/1973 | Germany | B65D 5/04 |
| 53-103070 | 2/1977 | Japan . | |
| 793015 | 4/1958 | United Kingdom . | |
| 1305829 | 2/1973 | United Kingdom | B65D 43/02 |

*Primary Examiner*—William Watkins
*Attorney, Agent, or Firm*—Sheldon H. Parker

[57] ABSTRACT

The invention relates to a composite cushioning system for protecting articles, packaged within a box, from damage while being transported in the box. The composite structure includes an expansion sheet of expanded slit sheet, in combination with a separator sheet. The expanded sheet has a slit pattern which produces open cells, preferably of a hexagonal configuration. The separator sheet precludes the nesting of legs and lands of the slit sheet with other slit sheet of the same slit pattern. A variety of combinations of separator sheets and expansion sheets can be used, such as a pair of expansion sheets with a separator sheet between the pair of expansion sheets, or two such pairs of expansion sheets, with or without a separator sheet between the pairs. The separator sheet can be unslit, or tear-perforated or slit to accommodate expansion. Where the separator sheet is slit, the slits preferably produce the same amount of expansion as produced in the expansion sheets. The equipment for expanding the composite uses expansion rollers having Velcro type hooks in a spiral around the rollers such that discontinuation gripping of the expanded material is provided.

23 Claims, 13 Drawing Sheets

U.S. PATENT DOCUMENTS

| | | | |
|---|---|---|---|
| 3,544,419 | 12/1970 | Gerard | 229/87.02 |
| 3,550,842 | 12/1970 | Scholtz | 229/87 |
| 3,603,369 | 9/1971 | Scholtz | 150/52 R |
| 3,642,967 | 2/1972 | Doll | 264/51 |
| 3,655,501 | 4/1972 | Tesch | 161/109 |
| 3,660,958 | 5/1972 | Garrison | 53/3 |
| 3,668,055 | 6/1972 | Gerard | 161/136 |
| 3,758,372 | 9/1973 | Fairbanks | 161/109 |
| 3,762,629 | 10/1973 | Bruna | 229/87 F |
| 3,825,465 | 7/1974 | Dtock | 161/112 |
| 4,105,724 | 8/1978 | Talbot | 261/112 |
| 4,265,956 | 5/1981 | Colijn | 428/134 |
| 5,203,761 | 4/1993 | Reichental et al. | 493/967 |
| 5,207,756 | 5/1993 | Alnumad et al. | 29/6.1 |
| 5,213,867 | 5/1993 | Huston, Sr. et al. | 493/967 |
| 5,275,677 | 1/1994 | Morley | 206/586 |
| 5,340,638 | 8/1994 | Sperner | 493/967 |
| 5,403,259 | 4/1995 | Parker | 493/967 |
| 5,431,985 | 7/1995 | Schilling | 428/182 |
| 5,439,730 | 8/1995 | Kelly et al. | 428/156 |

COMPOSITE PACKAGING MATERIAL HAVING AN EXPANDED SHEET WITH A SEPARATOR SHEET

CROSS-REFERENCE TO RELATED APPLICATIONS

This application is a CIP of 08/255,062 filed Jun. 7, 1994 now abandoned, and a CIP of PCT/US94/10209 filed Sep. 12, 1994, and a CIP of 08/157,277 filed Nov. 26, 1993, now U.S. Pat. No. 5,667,871 and a CIP of 08/119,472 filed Sep. 10, 1993 now U.S. Pat. No. 5,538,778, said 08/157,277 filed Nov. 26, 1993, now U.S. Pat. No. 5,667,871 is a CIP of 07/962,944 filed Oct. 19, 1992 now abandoned, and a CIP of 07/936,608 filed Aug. 27, 1992 now abandoned, said 08/119, 472 filed Sep.10, 1993 now U.S. Pat. No. 5,538,778 is a CIP of 07/962,944 filed Oct. 19, 1992 now abandoned, and a CIP of 07/936,608 filed Aug. 27, 1992 now abandoned, said 07/962,944 filed Oct. 19, 1992 now abandoned is a CIP of 07/851,911 filed Mar. 16, 1992 now abandoned, said 07/936, 608 filed Aug. 27, 1992 now abandoned is a CIP of 07/851, 911 filed Mar. 16, 1992 now abandoned.

BACKGROUND OF THE INVENTION

1. Field of the Invention

The present invention relates in general to the methods and apparatus to automatically produce a composite packaging material, from an expanded slit paper and a separator sheet.

The term expanding, as used herein, refers to a three-dimensional expansion, or a volume expansion. The material expands in length and thickness while decreasing in width, to yield about a twenty fold increase in volume.

2. Brief Description of the Prior Art

The performance and ecological disadvantages of cellular foam styrene and/or styrofoam peanuts as a void fill material is well known. The product does not biodegrade when in a landfill. It can be recycled through reuse, but recycling programs for plastics have met with limited success. The styrofoam and/or styrofoam peanuts have a very high volume to weight ratio, and the cost of storing and shipping the product is high, relative to the value of the product. Articles stored within a package and surrounded by styrene and/or styrofoam peanuts, freely migrate within the package and thus an article centered within a box when packaged, can be next to a side wall of the shipping container when transported. While a variety of products have been designed to provide a void fill substitute for styrene and/or styrofoam peanuts, each of the products has some major drawback. For example, starch products have been used, but tend to be excessively dusty and frangible. Products made from corn husks and other vegetation, are prone to attracting vermin, rodents and the like. Paper products tend to be low in bulk and thus have a high cost per cubic foot of void fill.

It has been disclosed that expanded paper can be used to wrap articles and as void fill for packages. The system is unique in that it expands the cubic volume of the sheet of paper by roughly 20 fold. The paper expands to twenty-two times its thickness, about 1.5 times its length, narrowing down to about 80% of its original width. Expansion thus produces a total volume increase roughly equal to or greater than the thickness increase.

The expanded paper product is substantially more expensive, on a volume basis than the commonly used void fill material, styrene and/or styrofoam peanuts, although its performance as a protective cushioning material is substantially greater than that of styrene and/or styrofoam peanuts. Thus, the expanded paper has superiority over styrene and/or styrofoam peanuts when used as a void fill material where cushioning, damage prevention, protection of land fills, use of recycled products or ability to recycle is required, but is more costly than styrene and/or styrofoam peanuts on a volume basis.

It is thus an object of the invention to reduce the cost, on a volume basis, of expanded paper packaging material.

It is another object of the invention, to produce a void fill product which can be shipped in the unexpanded form, and expanded at the user's site, at a cost competitive with that of styrene and/or styrofoam peanuts.

SUMMARY OF THE INVENTION

An apparatus for producing a composite packaging material comprising a first paper roll of unexpanded, expandable slit sheet material, a first pair of drive rolls, and a first pair of expander rolls. Gripping means on the expander rolls engage the expandable material without crushing the expanded material. The gripping means are preferably a plurality of moderately firm bristles uniformly distributed along the surface of at least one of the expander rolls. The bristles have hook means on the outer end, the barb of the hook being oriented in the leading position so that the barbs engage the slits in the material during the rotation of the expander rolls. In one embodiment, a plurality of moderately firm bristles is uniformly distributed along the surface of the first expander roll in a spiral pattern, and a plurality of moderately firm bristles uniformly is distributed along the surface of the second expander roll in a spiral pattern. The first and second expander rolls are spaced apart a distance such that the distal ends of the bristles of each roll extend into openings in the slit material when expanded. The spiral pattern provides spiral regions of bristles and spiral regions free of bristles. Therefore, the expanded sheet material is firmly engaged by drive roll bristles when a region of bristles of one drive roll is opposed by a region of bristles of the other drive roll. Preferably the bristles of the first expander roll oppose the bristles of the second expander roll during a portion of the rotation cycle, thereby grabbing said unexpanded paper. The bristles are unopposed during the remainder of the rotation cycle, thereby engaging expanded slit sheet material without crushing.

Means are provided for delivering the expandable material from the first paper roll to the first pair of drive rolls. The expandable material extends from the first paper roll to the pair of drive rolls, and from the drive rolls to the expander rolls. At least one of the expander rolls has gripping means on its surface to grip the slit material. The expander rolls have an effective peripheral rotational speed greater than the effective peripheral rotational speed of the drive rolls. The rotation of the drive rolls therefore draws material from the first paper roll while the greater rotation speed of the expander rolls expands the expandable material in length and thickness.

In another embodiment, the apparatus has at least a second paper roll of unexpanded, expandable slit sheet material, a second pair of drive rolls and a second pair of expander rolls. The expander rolls have gripping means for engaging the expandable material. A method for delivering the expandable material from the second paper roll to the second pair of drive rolls is provided. The expandable material extends from the second paper roll to the second pair of drive rolls and from the second pair of drive rolls to the second pair of expander rolls. At least one of the expander rolls has slit material gripping means on its surface. The expander rolls have an effective peripheral rotational speed greater than the effective peripheral rotational speed of the drive rolls. Therefore rotation of the second pair of drive rolls draws material from the second paper roll and the greater rotation of the driver rolls expands the expandable material in length and thickness.

In additional embodiments a third and a fourth paper roll of unexpanded, expandable slit sheet material is incorporated. Means for delivering the expandable material from from the third and said fourth paper roll to the second pair of drive rolls and from the second pair of drive rolls to the second pair of expander rolls.

A roll of separator sheets between each expandable sheet prevents nesting of adjacent expanded sheets. Means are provided for delivering the separator material from a first roll of separator material to the first pair of expander rolls, without passing through the drive rolls. The separator sheet delivery means delivers the separator material parallel to and in close proximity with the expandable material from the first and second pair of expander rolls, without passing through the expander rolls.

At least a second paper roll of expandable slit sheet material is delivered from at least a second paper roll to the first pair of expander rolls, extending from the second paper roll to through the drive rolls, to the second pair of expander rolls, to simultaneously form at least two layers of expanded sheet material from the same expander rolls.

The apparatus for producing a cushioning structure can include, for example, three or more rolls of separator sheet material and four or more rolls of expandable sheet material. Any desired combination of expandable sheets and separator sheets can be fed to the guide rolls, driver rollers and expansion rollers, depending upon the configuration of the composite cushioning material. Where the composite cushioning structure is to be in the form of a pad, an outer sheet of kraft paper is fed through the apparatus above the upper sheet of expandable material and an outer sheet of kraft paper is fed below the lower sheet of expandable material. The kraft paper can also be used as separator sheets, or the separator sheets can be of modified configuration. The outer sheets of kraft paper can be fed through the expansion rollers along with, but outboard of the expandable sheets, or can be provided with its own feeding mechanism. Where a single separator sheet is to be fed between two expandable sheets, each of which passes through its own pair of expansion rollers, the separator sheet can be fed along with, but inboard of one of the expandable sheets, or can be provided with its own feeding mechanism. The middle separator sheet can be guided through the apparatus but unpowered, if the separator sheet is manually pulled through the apparatus by the user. Where a composite pad is being produced, all sheets, including both the separator sheets, outer sheets and expandable sheets is are preferable fed through powered rollers.

Where a pair of webs of expandable sheets are fed through a single pair of guide rollers and expansion rollers, a separator sheet web can be fed between the two webs of expandable sheets and drawn through the system by the expandable sheets. The gripping elements on the expansion rollers has sufficient drawing power to pull through unslit as well as slit sheets. Thus, a composite cushioning structure can be produced which has any combination of expandable sheets and separator sheets. The apparatus preferably provides for at least five layers of unslit sheets and four layers of expandable sheets. The apparatus can selectively feed any combination of expandable and separator sheets to form combinations in which every layer of expandable sheets is separated from an adjacent layer of expandable sheet by a separator sheet as well as combinations in which two or more layers or expandable sheets are permitted to nest. Additional combinations which can be used, include the alternating of the inclines of adjacent layers of expandable sheet material in order to minimize, but not eliminate nesting of adjacent expanded sheets.

Where a cushioning or void fill pad or envelope is to be constructed a mechanism, such as knurling rollers or adhesive applicators, as well known in the art. The various layers of separator sheets, expanded sheets and outer unexpanded sheets can be knurled or glue together. Where separator sheets are narrower than the expanded width of the expanded sheets, the binding of layers preferably excludes the narrow separator sheets, thus simplifying the binding operation.

The pad structure can readily be formed into an envelope by folding over and at least peripherally bond the pad to itself at three sides. Closure flaps can be provide by having the fold line offset from the midpoint of the pad.

Where the expander rollers are covered with a spiral pattern of gripping filament, such that there are spiral regions of filaments and spiral regions free of filaments crushing of expanded sheet material is reduced or eliminated. The spiral regions of the two expander rollers can be slightly offset so that only a portion of the spiral filament regions of one roller mates with only a portion of the spiral filament regions of the other roller, serves to maximize the gripping effect of the spiral configuration, while minimizing the crushing. In essence, the expanded sheet material is gripped at intermittent regions, by the limited mating of the spiral filament regions. In the configuration where the separator sheet is narrower than the expanded sheets, and the outer regions of said expanded sheet is not separated from adjacent layers of expanded sheet material, the outer region are free to contract, nests and interlocks with adjacent layers of expanded sheet material. In this manner, both the advantages of nesting and non-nesting are obtained.

Preferably, the expanded sheet has a slit pattern which produces hexagonal cells in order to form a highly rigid structure. The separator sheet can be provided with a slit pattern which provides expansion capability, but it need only provide for limited expansion and it does not have a complementary slit pattern. Therefore the separator sheet does not nest with the expanded sheet. Preferably, the separator sheet is substantially free of expansion slits. The separator sheet can be provided with intermittent unslit and expansion regions, such that the expansion regions cover a minor portion of said separator. In this manner, limited expansion is provided and nesting is precluded over at least a majority of the surface of the separator sheet.

In order to accommodate the expansion of the expanded which is necessary as part of the wrapping step after the composite exits the expansion rollers, the separator sheet can be provided with a transverse tear line, such that the separator sheet can be torn into discrete sections. The use of limited expansion slits or a tear line provide sufficient expansion for the expanded sheet and the separator to be simultaneously expanded together, on the order of about five to twenty percent, after passage of the expanded sheet through expansion rollers. In this manner the the expanded sheet-separator sheet combination can be pulled taut during the wrapping operation.

BRIEF DESCRIPTION OF THE DRAWINGS

The advantages of the instant disclosure will become more apparent when read with the specification and the drawings, wherein.

DETAILED DESCRIPTION OF THE INVENTION

Figure 1:
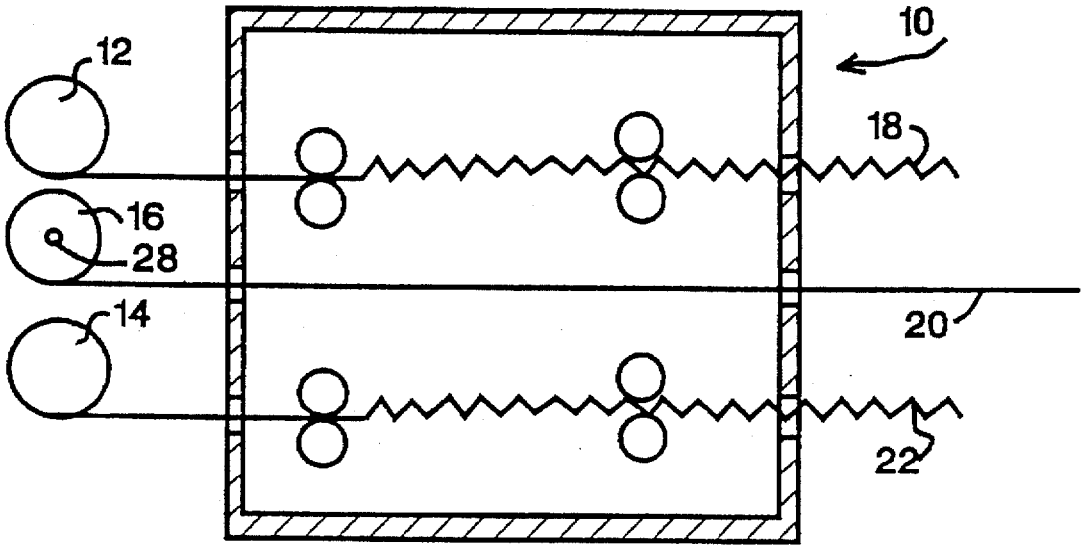
FIG. 1 is a side view of a multi-layer expander for production of a three layer product.

It has now been found that expanded sheet material which has a slit pattern which produces open cells, can be used in a modified form to produce a multi-layer cushioning material. This multi-layer cushioning material has a volume cost competitive with styrene and/or styrofoam peanuts while providing better cushioning characteristics.

It would be expected, based on prior art teachings, the resultant product of separating two sheets of expanded, multi-angled cell pattern paper, with a sheet of unslit paper, would result in a decreased cost effectiveness. This is the expected response due to the lost of volume originally created through expansion, when combined with unexpanded paper. The loss of volume resulting from the combination would be expected to reduce the height of the paper by half since in the combination two sheets only produce the height of the cells and the height of an unexpanded sheet. That is to say, the combination of expanded and unexpanded paper would have a net thickness which is the average of the expanded sheet and unexpanded sheet thus, the combined thickness enhancement of an unexpanded sheet and a sheet expanded 20 fold, would be 10 fold.

The paper, once expanded creates semi-rigid peaks or lands. These peaks are similar to a spring in that once force is applied and removed, they return to their original positioning, providing the elastic limit is not exceeded. The elastic force created by the resistance of the paper fibers slows the acceleration of the force. The work performed by movement of the semi-rigid peaks as a force is applied by an article, is the elastic potential energy of the expanded material. The yield point is the point beyond stress when a large increase in strain occurs with almost no increase in stress.

While any slit pattern for expanding the paper can produce an effective packaging material, when used in combination with an unexpanded sheet, the use of a pattern which produces hexagonal cells is preferred due to the high rigidity of the hexagonal cells. Hexagonal cells are rigidly self-supporting as compared to oval cells which close readily under load.

The expanded sheet retracts to some degree when it leaves the expansion rolls, if not bound at its sides to an unslit sheet of paper. With the identical paper, load bearing capacity is dramatically increased with the hexagonal pattern, as compared with a diamond cell yielding slit pattern. The cushioning characteristics of the structure can be further modified and is dramatic with respect to certain applications, by separating layers of the expanded sheet material from each other and thus precluding the nesting of adjacent cells as disclosed herein.

It should be noted that the expanded product nests, and thus, the thickness of nested multiple layers is less than the sum of measuring the thickness of the same number of unnested layers.

It has, however been found that the combination of unexpanded with expanded paper does produce an economical multi-ply cushioning material. Also unexpected is the cushioning affect this material exhibits.

The multi-ply structure has particular utility as a low cost void fill material. The use of a multi-layer combination allows the paper weight on both the expanded and unexpanded paper to be lowered. A 40 and 50 pound recycled kraft paper can be used for the expanded layers due to its stiffness and resiliency. The unexpanded, separator sheet can use a light weight separator of 40 kraft paper or less. A multi-layer combination using unslit kraft paper and slit paper forming a hexagonal cell produces a void fill having a cost roughly comparable to that of styrene and/or styrofoam peanuts, while providing better performance. Additionally, the ecological advantages of one hundred percent post consumer, recyclable wrap, over ecologically unfriendly styrene foam peanuts, are obvious.

Once the unique advantages of the multi-layer combinations were recognized, a method for rapidly producing the combinations required development.

Positioning an unexpanded sheet of low cost, light weight kraft paper between each layer of expanded hexagonal sheets, results in a final thickness which is equal to the full thickness of the sum of the thickness of each individual unexpanded and expanded sheet. The resultant cushioning is different from the highly resilient cushioning which is produced by the interaction of nested sheets. Surprisingly, the change in cushioning is not simply a loss of cushioning, but rather a change in cushioning performance characteristics. The highly resilient, high loft, stiff cushioning, is highly suited to void fill applications due at least in part, to the very thick product having spongy cushioning which is produced when the expanded sheet layers is interlayered with an unexpanded sheet.

The separator sheet is distinguished from the expanded sheet by virtue of not having a cooperating or matching slit pattern. The separator sheet is defined as a sheet which does not nest with the lands and or legs of the expanded sheet, but rather, distributes impact from the expanded sheets to from the legs and/or lands of the expanded sheet to at least cell sized regions of the next layer of expanded sheet. The separator sheet causes each leg and land to operate independently, rather than in nested groups. Mixed combinations of nested and separated expanded sheets layers can be used to provided properties which are customized to a particular application.

At one extreme, the separator sheet can be a simple sheet of paper. In this embodiment, the sheet is freely fed along with one or more expanded slit sheets. By virtue of being free to unwind along with the wrapping motion, the separator sheet can accommodate and keep up with the rate at which the expanded sheet is being fed. The separator sheet can be coupled to a single expanded sheet, or it can be between expanded sheets. When drawing on the expanded sheets during the wrapping operation, the expanded sheet is elongated beyond the initial expansion produced by a powered expander. Therefore, the separator sheet has to be able to accommodate a feed rate greater than that of the expansion rollers. Where the separator sheet is between expanded sheets, it is preferred to simultaneously feed the composite through a single pair of expansion rolls. Since the system limits the feed rate of the separator sheet to that of the expanded sheets, the separator sheet restricts the further expansion of the expanded sheet, as required to wrap with an interlocking action. It is noted that the expanded paper exhibits a contraction force when expanded. It is this contraction force which maintains the sheet in the interlocked state. Once expanded by the expansion rollers, the expanded sheet or sheets contract to a relaxed stated. The separator sheet can have a tear line formed by a line of perforations, which can be small, closely spaced holes, large holes or elongated slits. The line is transverse to the machine direction of the paper, that is, at a right angle to the edges of the paper.

Alternatively, the separator sheet can be provided with a narrow region of slit patterns transverse to the machine direction of the paper. The machine direction of the paper, is the direction in which the paper is fed to and from the roll on which it is wound. This is also commonly referred to as the longitudinal axis of the paper. The expansion region is designed to provide the same degree of expansion from region to region, as is obtained from the pulling of the expanded sheet taut during the wrapping operation. The additional expansion used to spring load the expanded sheet, is less than 25% of the length of the region, and generally is on the order of five to ten percent. Thus, the expansion region of the separator sheet can be conveniently spaced at one or two foot intervals and needs to provide from one to about four inches of expansion. Expansion of about one inch per foot generally provides sufficient extension to permit the requiring pulling of the expansion sheet to the taut condition. Obviously, providing for more expansion than necessary is not detrimental, though the converse, providing insufficient expansion is undesirable and can interfere with the interlocking feature. Where the composite is used to produce a pad or envelope, the expanded slit sheet is not pulled taut and an expansion or tear region is unnecessary.

It appears that cushioning enhancement is produced due to the way in which the separator sheet distributes the impact load from the outer layer to inner layers. In hexagonal cells, load is distributed from lands to legs and then from legs to lands, within a layer. Between layers, the distribution is from land to adjacent nested land and from leg to adjacent nested land. The inner layer then distributes impact within across the layer. Thus impact is distributed both within the outer layer under deflection and to inner layers of expanded sheet material.

Where a separator sheet is used the distribution of impact from outer expanded layer to inner expanded layer is through the unexpanded separator sheet. The separator sheet appears to flex and distribute impact to cells or groups of cells, rather than from leg to adjacent nested leg or land. The change in effect is, surprisingly not a loss of impact absorption capacity, but a change in the type of impact absorption which the cushioning material is undergoing.

The weight of the expanded sheet material can be selected based on the required performance. The weight of the separator sheet need not be greater than 30 or 40 pound kraft paper, since its function is strictly as a separator. Thus, the combination of the separator sheets produces a product which has almost 50% greater thickness than when the separator sheet is not used. The structure is two layers of open cell sheet material, preferably hexagonal cells, separated by a separator sheet and wrapped around itself to produce a plurality of layers of the multi-ply structure. For example, twenty layers of single-ply hexagonal cell sheet material wrapped in a flag fold, will yield a thickness of roughly 40% less than ten layers of two-ply, separator sheets wrapped in the same flag fold. The separator sheet layer can be extremely light weight paper, on the order of 40 weight paper or less, down to the weight of the "tissue" paper commonly used as a wrap or separator material in the packaging of garments.

When used to wrap articles, it is preferable that the separator sheet be narrower than the expandable sheets, by an amount at least equal to the shrinkage or necking down of the expandable sheet material during expansion, so as to leave the outer two ends without separator sheet material. In this manner, the wrapping operation can produce a wrap in which the wrap extends beyond both ends of the article being wrapped. The region around the article is fully stretched and remains that way due to the interlocking action. The ends of the wrap beyond the article neck due to the contraction force of the expanded sheet. The absence of a separator sheet in the outer region preserves the necking down tendency, and produces an enclosed article, locked in place by the narrowing of the wrapped beyond the ends of the article. In this format, a single layer of expanded sheet material can be interleaved with a single layer of unslit sheet material, with the outer end regions of the slit sheet providing the desired interlocking effect. It may be, however, necessary to use glue or tape in some instances to preclude unwrapping of the cushioning material, since the separator sheet precludes interlocking along the "body" of the article.

Figure 18:
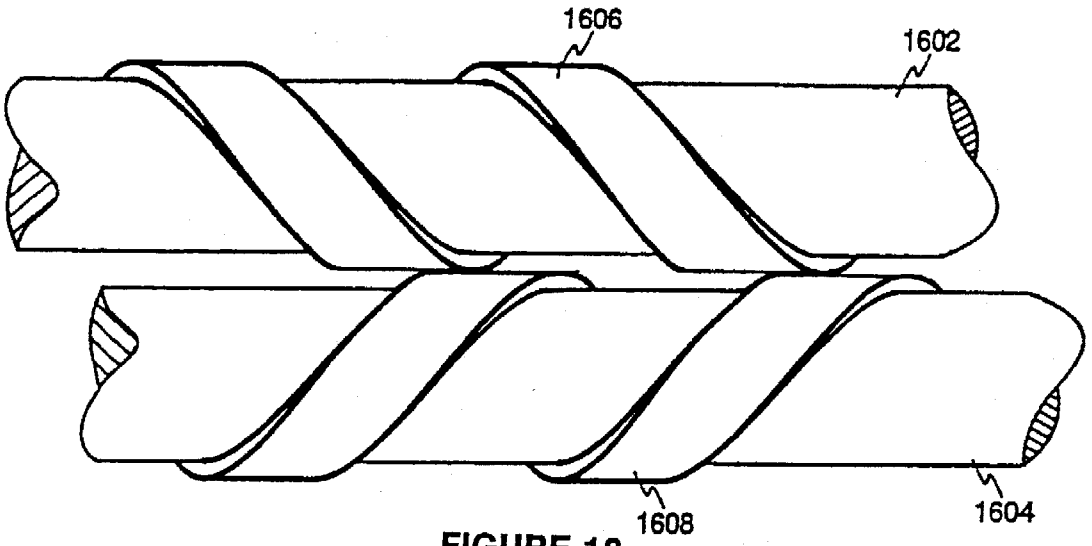
FIG. 18 is a view of hook filament material wound around the expanded roll.
Figure 19:
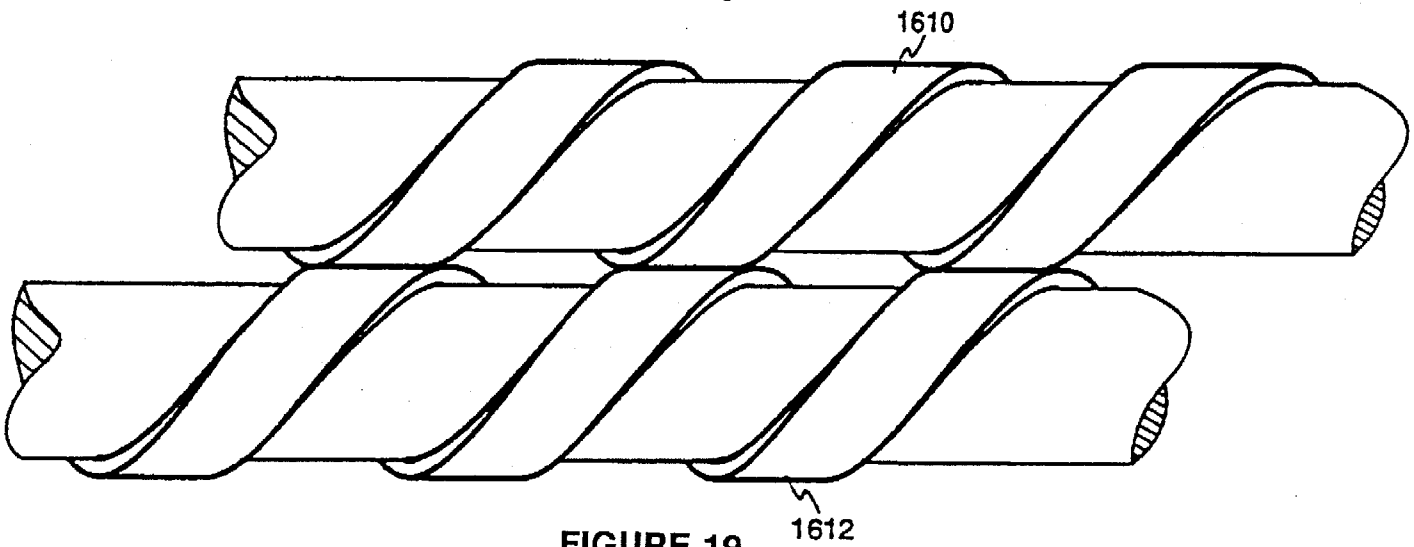
FIG. 19 is an alternative view of hook filament material wound around the expanded roll.

The expansion is preferably performed in a modified expander of the type disclosed in copending patent application, Serial Number, used for producing single or dual webs of expanded sheet material. As previously disclosed, the expansion rollers are covered with offset layers of filamentary material, such as the hook-like fabric portion of the hook and loop material sold under the trademark Velcro, as shown in FIGS. 18 and 19 herein. Surprisingly, two layers of expandable sheet material separated by a light weight unslit separator sheet, can be processed in a single pair of rollers. By offsetting the hook and loop fabric windings of the two rollers, crushing of the expanded material is precluded, even when multi-ply sheets are processed. The ability to draw multilayers of the expanded paper through the same pair of rollers, without crushing, is so effective, that no crushing occurs, even when a pair of expandable sheets are separated by a separator sheet. The thickness of material passing between the expansion rollers is about 50% greater when two pairs of unseparated webs are simultaneously processed. However, when two webs, separated by an unslit sheet are simultaneously processed, the resultant thickness is roughly double that of a single web due to the elimination of nesting. The hook filaments must be positioned close enough to one another to apply sufficient pressure to the double webs to grip unexpanded lead material and transform it into expanded material.

The expander is preferably provided with the ability to automatically readjust. This provides the ability to have a closer position at start-up to provide substantial gripping of the unexpanded paper and a further apart position after a momentary, start-up period. The start-up period need only be long enough to permit several inches of paper to pass between the pair of rollers, before movement to the normal expansion operation position is restored. The movement can be on the order of the thickness of one or more layers of expanded sheet material. The rollers are preferably provided adjustments with high and low settings for optimum performance.

Where multi-layer or webs of expanded sheet material having eight inch slit row spacing, are fed through a single pair of expansion rollers, the spacing between the expansion roller is increased about three sixteens of an inch per expanded sheet. The flexibility of the hook filaments provides a substantial tolerance for expanding without crushing. The expansion rollers are preferably powered for parallel movement, in order to regulate the spacing between the rollers. By this mechanism, the startup spacing can be narrow followed by an increase to accommodate the expanded thickness of each sheet. Where expanded sheets are not separated, the spacing of the pair of parallel expansion rolls will be less than were the expanded sheets have a separator between them to prevent nesting. Thus, where two sheets of expanded paper and two outer sheets of kraft paper are fed through the expansion rollers, the roller spacing is less than where a separator sheet is used between the pair of expanded sheets. The spacing will be less where two sheets of expanded paper.

The basic expander, as described in the incorporated copending applications, is redesigned to allow for the production of the multi-layer combination.

In FIG. 1 the tri-layer expander 10 is shown wherein slit rolls 12 and 14 are positioned above and below the separator roll 16. The slit rolls 12 and 14 are each expanded through dual pairs of expansion rollers. As the expansion rollers used relating to slit roll 12 and slit roll 14 are identical, only one set will be described in detail herein. The expansion process, incorporating the guide rollers and expansion rollers is described further herein in FIGS. 14–19. The separator paper 20 is fed from the separator roll 16 located between the slit rolls 12 and 14. The separator roll 16 is free floating on the roller support 28 and, as there are no expansion rollers to restrict the movement, the separator paper 20 freely unrolls as it is pulled. To prevent the separator paper 20 from continuing to unroll due to momentum, any restraining method, such as a friction fit between the roller support 28 and the core of the separator roll 16, can be used. The paper must, however, be allowed to freely unroll as needed. The slit paper 18 and 22 are separated by separator paper 20 as the paper is removed from the expander 10 and rolled around an article.

Figure 2:
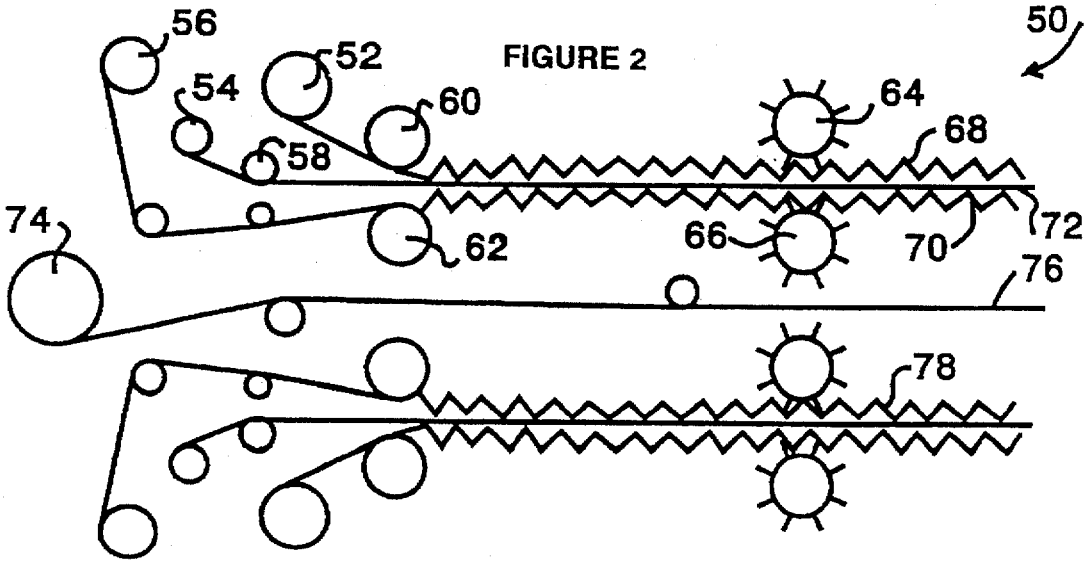
FIG. 2 is a schematic of a multi-layer expander for product of a seven layer product.

FIG. 2 illustrates an alternate expander 50 which is similar to the expander of FIG. 1 in that there are three delivery areas. The expander 50 has a first delivery area which comprises slit paper rolls 54 and 56 and separator roll 54. The rolls are placed to allow for the separator roll 54 to be delivered between the slit paper roll 54 and slit paper roll 56. The separator paper 72, as illustrated, is removed from the roll 54 and held in position for delivery by positioning bar 58. The configuration illustrated herein is only one example of the positioning of the rolls. One or more positioning bars can be provided to place the paper in the position required for smooth entry into the guide rollers 60 and 62. The slit paper 68 and 70 passes through the guide rollers 60 and 62 and expansion rollers 64 and 66, expanding as described further herein. The separator paper 72 from separator roll 54 is also run through the guide rollers 60 and 62 and expansion rollers 64 and 66. The separator paper 72 is, therefore, subject to the same physical pulling as the slit paper 68 and 70. In order to prevent the separator paper 72 from tearing during the expansion stage between the guide rollers 60 and 62 and the expansion rollers 64 and 66, the separator paper 72 is provided with slits. The slit pattern in the separator paper 72 cannot be the equivalent to the slits pattern as disclosed for the slit paper, as this would result in three layers of expanded slit paper. An expansion of approximately 10–20% of length is required of the separator paper 72 and any of a multitude of patterns can be used. The slit pattern used for the slit paper can be used, however the slit size and ratios must be different from those used in the slit paper 68 and 70 to prevent nesting. If a slit pattern is utilized, it is preferable that the pattern be such that the paper, when expanded, does not form the resilient hexagons, thereby providing the firmer support provided by unslit paper. The separator paper 72 preferably does not tear, it expands to a configuration which nests with the expanded paper 68 and 70 and must expand approximately 10% of its length. The slit pattern to produce this criteria can vary dependent upon manufacturing preferabilities. The expansion capabilities can be greater than 10–20%, however expansion beyond 10–20% is unlikely. The second delivery area is the center separator roll 74 which separates the first and third delivery areas. The center separator sheet 76 prevents the expanded paper 70 from nesting with the expanded paper 78. The third delivery area is the same as the first delivery area, although the positioning of the roll may differ. The multi-layer combination produced with the expander 50 provides a separator sheet between each of the expanded sheets, preventing nesting. This provides cushioning in a more bulky, rigid form and is preferable for wrapping larger objects. It should be noted that any number of delivery areas can be combined in the same manner as disclosed in this Figure.

It should be understood that the unslit sheet material need not be totally free of slits. Since in some embodiments the unslit paper is placed in both the guide rollers and the expansion rollers, some expansion capability is required. Therefore, slits are used in the unslit sheet to for expansion purposes rather than for thickening of the product. In this instance, the slits should be longer than those used for cushioning expansion and can be at intervals along the length of the sheet rather than uniformly distributed along the sheet, as is the case for the expansion sheet.

Thus, a long slit can be used to produce large cells, and consequently a high amount of lengthening upon expansion. If the resultant cells are twice as large as those for the expanded cushioning layer, half as many cell should be used, with the critical factor being the achievement of equal expansion for the slit and functionally "unslit" layer.

Thus, a tear-a-way zone, interval zones or reduced number of larger cells can be used in the separator sheet to equalize the expansion of the slit sheet and separator sheet.

Figure 3:
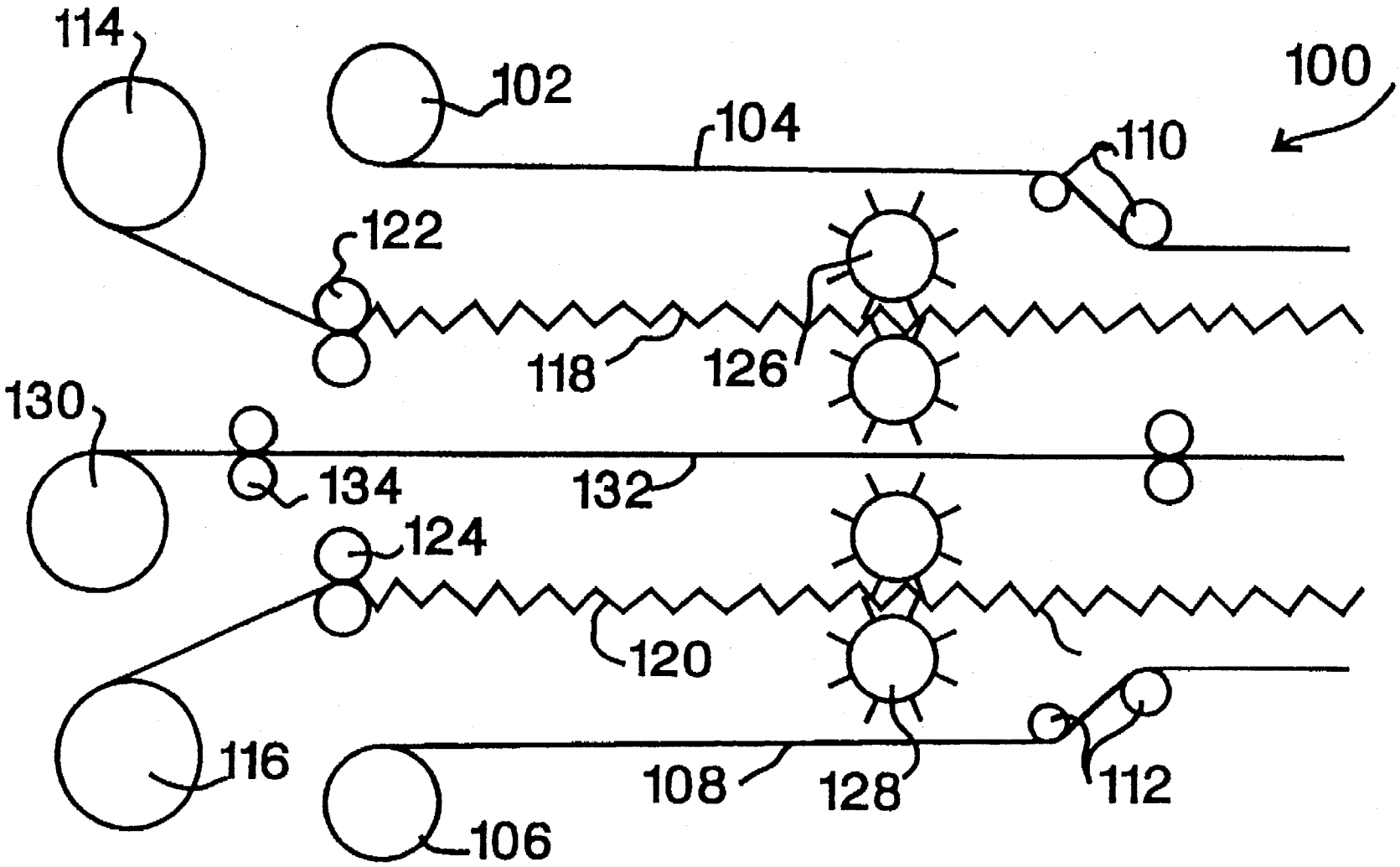
FIG. 3 is a schematic of a multi-layer expander for product of pads and envelopes.

The expander 100 as shown in FIG. 3 utilizes the same basics as described heretofore. The expander 100 has the delivery systems arranged to provide the capability of producing envelopes. The rolls 102 and 106 are unslit kraft paper, at least one of which has a weight sufficient to provide exterior envelope protection. The exterior paper 104 and 108 is placed through dual guide rollers 110 and 112 which are utilized to maintain alignment of the paper 104 and 108. The expanded paper rolls 114 and 116 are positioned to deliver expanded paper adjacent to the exterior paper 104 and 108. The slit paper 118 and 120 is expanded, as described further herein, through use of dual guide rollers 122 and 124 and expansion rollers 126 and 128. A center separator sheet 132, fed off a center separator roll 130, is used to prevent expanded paper 118 and expanded paper 120 from nesting. The center separator sheet 132 can be provided with one or more positioning rollers 134 to maintain the positioning of the center separator sheet 132. Again, by separating the expanded paper 118 and 120 nesting is prevented. The multi-layer combination 152 can be used for either wrapping or as a cushioning pad or envelope. The combination 152 is ideal for a pad as exterior paper 104 and 108 provide resilience and protection for the interior portions. The combination 152 can be cut into predetermined pad sizes and sealed along the edges by knurling or other means well known in the art.

Figure 4:
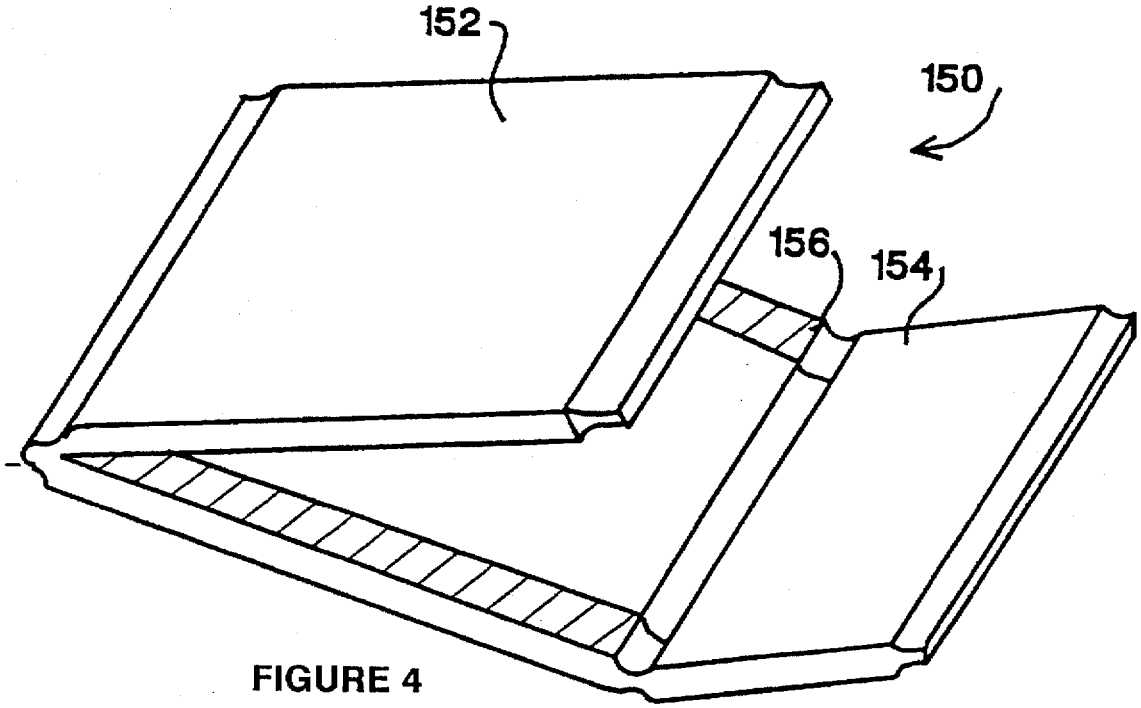
FIG. 4 is a perspective view of the protective envelope produced from the product produced by the expander of FIG. 3.
Figure 5:
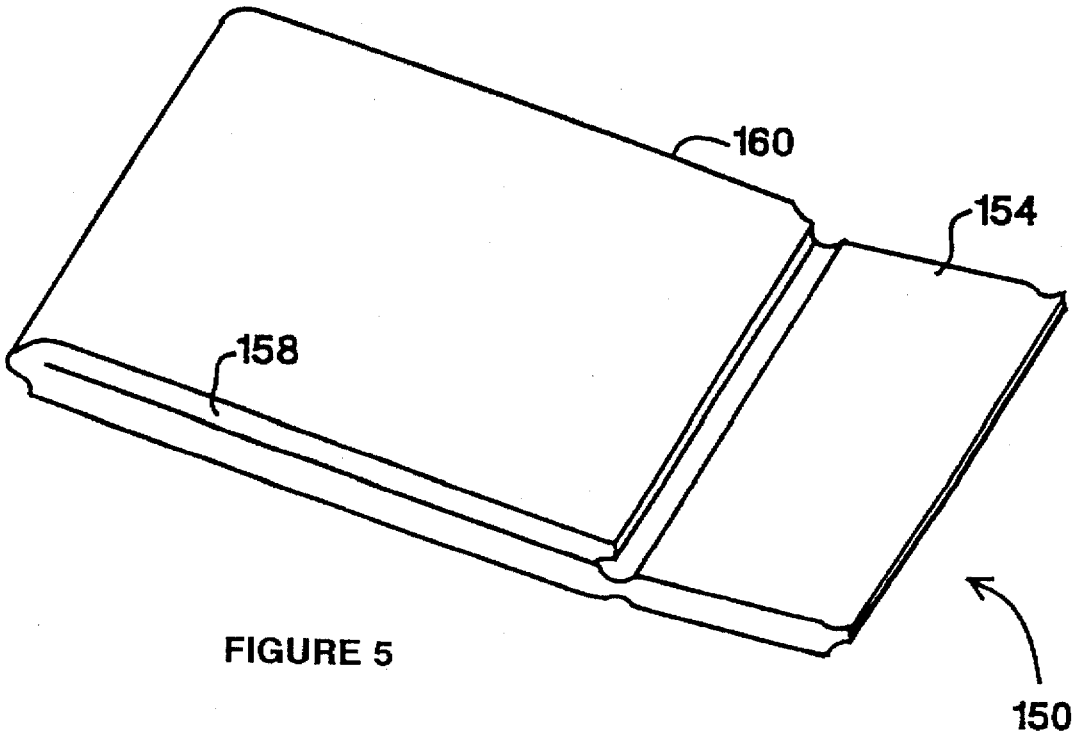
FIG. 5 is a perspective view of the completed envelope of FIG. 4.

The combination produced by the expander 100 of FIG. 3 is ideal for use as a protective envelope. The combination 152 is cut at a predetermined length, approximately two and ¼ the length of the desired size envelope 150 as illustrated in FIGS. 4 and 5. In FIG. 4 the multi-layer combination 152 has been folded over onto itself, leaving closure flap 154 as a single layer of the multi-layer combination 152. The envelope 150 is sealed along the peripheral edges 158 and 160 by means known in the art. Alternatively, the cut pad of combination 152 can be folded to produce an envelope which does not incorporate the closure flap 154 and is sealed through stapling. The advantage to using the exterior weight kraft paper for the exterior paper 104 and 108 is in the ability to fold the combination 154 to either expose exterior paper 104 or exterior paper 108. Alternatively, either paper 104 or 108 can be replaced with a lighter weight paper, however the direction of folding must correspond accordingly. The outer edges of the envelope are sealed using means well known in the envelope art.

The cushioning pad can consist of the output from two or more pairs of rollers combined to form a unity structure. The final structure can consist of four layers of expanded sheet material separated by light weigh separator sheets and covered top and bottom, by outer layers of unslit kraft paper. The resultant product provides extreme loft as a result of the separation of the sheets of expanded paper. The two inner layers of expanded sheet material can be unseparated to provide greater resiliency, or separated by a separator sheet to provide greater stiffness. That is, four layers of expanded sheet material can be combined with either four or five layers of unslit paper. The outer sheets of unslit paper is preferably of a higher weight paper than the separator sheets, so as to provide greater resistance to tear during use. The inner, separator sheets are not exposed to abuse and can be an extremely light weight, low cost paper. The structural demands of the separator sheets is so minimal that paper weights normal unsuited to producing a cushioning material that can be advantageously, with great economic advantage.

Figure 7:
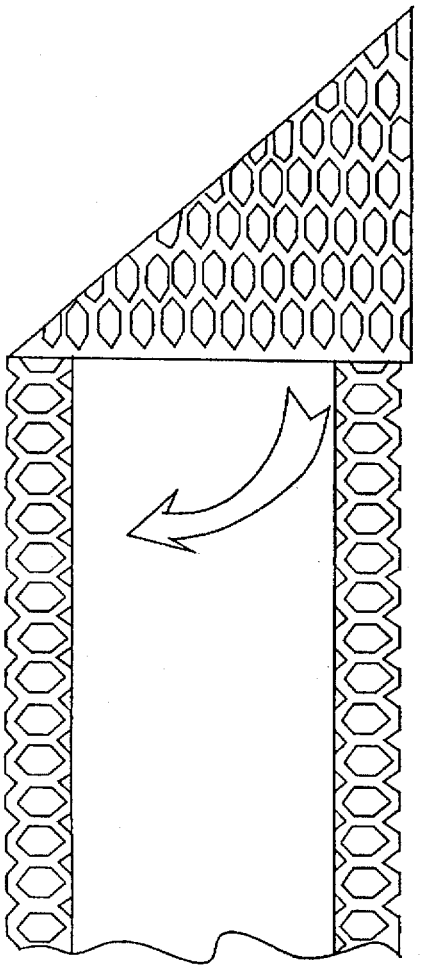
FIG. 7 is a front view of the continued flag fold of FIG. 6.
Figure 6:
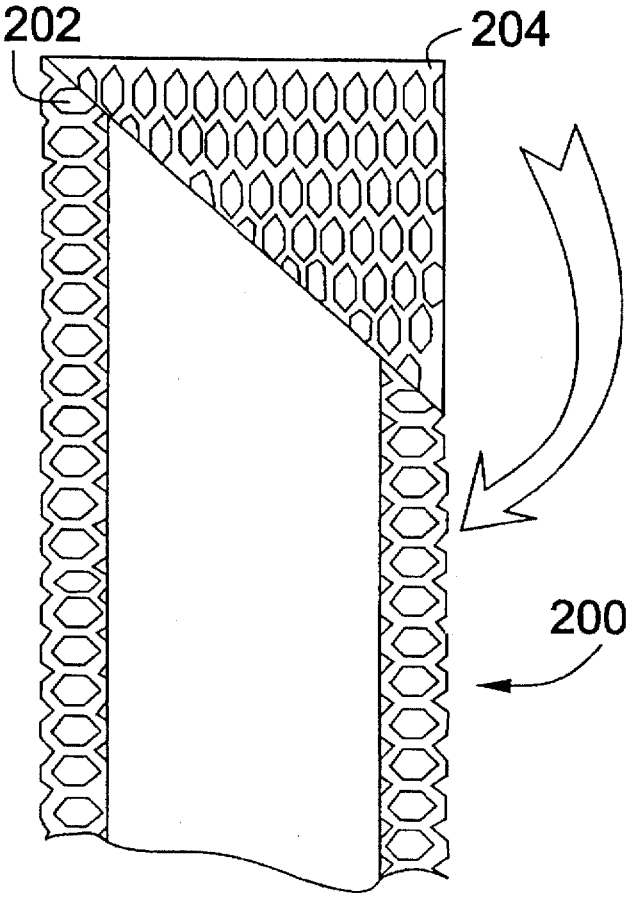
FIG. 6 is a front view of the flag fold using the product produced by the instant method.

A flag fold 200 is illustrated in FIGS. 6 and 7 utilizing the above disclosed multi-layer combinations. A long strip of the multi-layer combination 202 is folded in a manner similar to the customary fold for flags. A corner is folded back on itself, diagonally, to produce a triangular region 204 which is then folded back. The sheet is repeated folded back on itself, diagonally, to form triangular regions and the process is repeatedly until the desired thickness of material is produced. The cell pattern is rotated forty-five degrees between layers, thus producing reduced nesting in multi-layer combination where the expanded paper comes in contact with itself. However, even with the ninety degree rotations of the cell pattern, nesting does occur. If a stiffer flag fold is desired, multi-layer combination product using separator paper on at least one side is used. This can be obtained through use of the multi-layer combination 152 produced with Expander 100. Alternatively, the first and second delivery areas shown in FIG. 2 in conjunction with expander 50 can be used.

Figure 8:
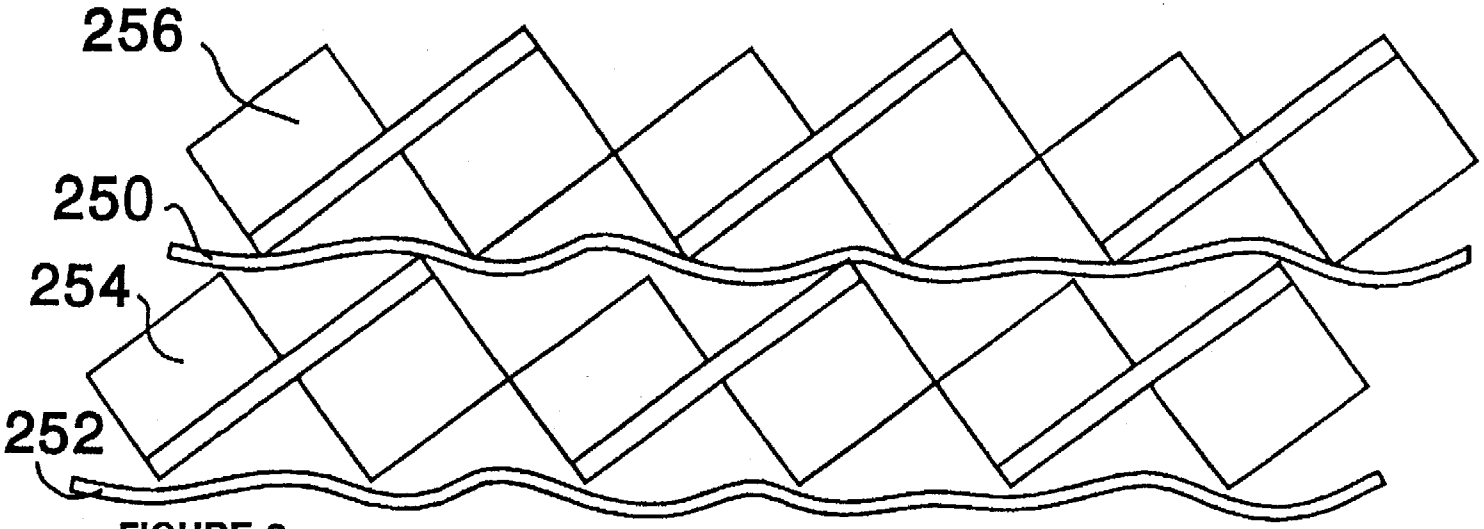
FIG. 8 is side view of the expanded paper and separator paper combination.

FIG. 8 illustrates, from a side view, how the separator sheets 250 and 252 prevent the expanded sheets 254 and 256 from nesting. The peaks of the expanded paper 256 and 254 rest on the separator sheet 250 and 252 thereby causing impact to be transmitted through the separator sheets 250 an 252 as described in detail further herein.

Figure 9:
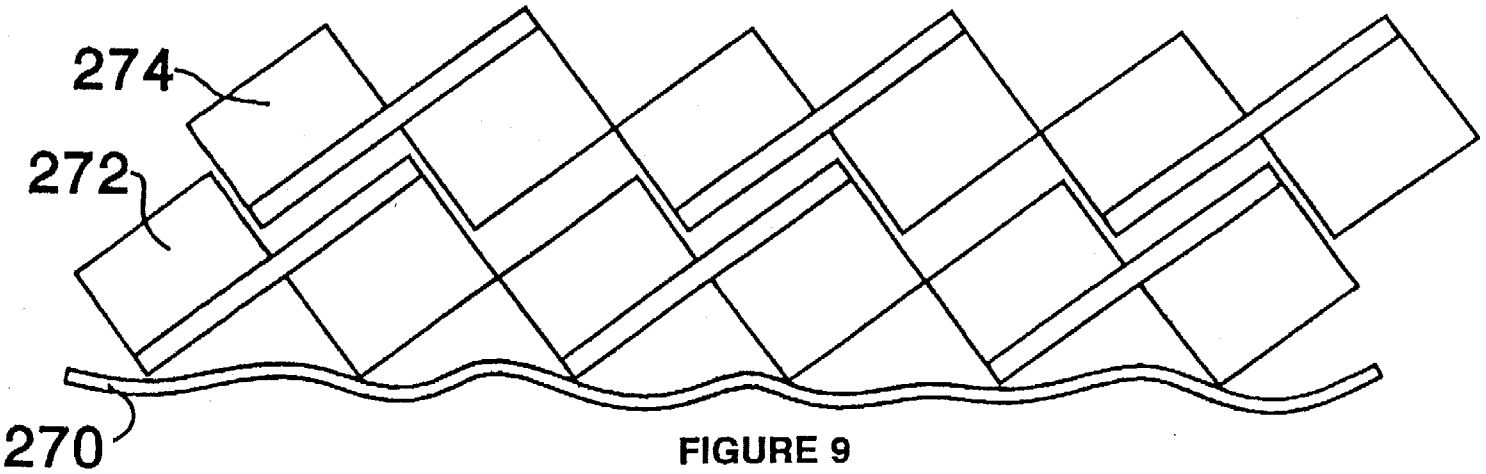
FIG. 9 is side view of two sheets of expanded paper having reverse inclines in combination with a separator paper.

Decreased nesting can also be obtained by reversing the incline of the lands of the cells as shown in FIG. 9. Separator sheet 270 is used in this Figure in combination with the expanded sheets 274 and 272, however the incline reversing can be used without the separator sheet 270. That is, if the inclines are about 60 degrees, reversing the direction of the inclines of each layer of expanded sheets 272 and 274, reduces the nesting. Ten sheets of expanded paper having an individual expanded thickness of about 4 mm, will have a combined, nested thickness of about 2.5 inches. Nesting can also be substantially negated by wrapping the expanded paper in the flag fold described in FIGS. 6 and 7.

Figure 10:
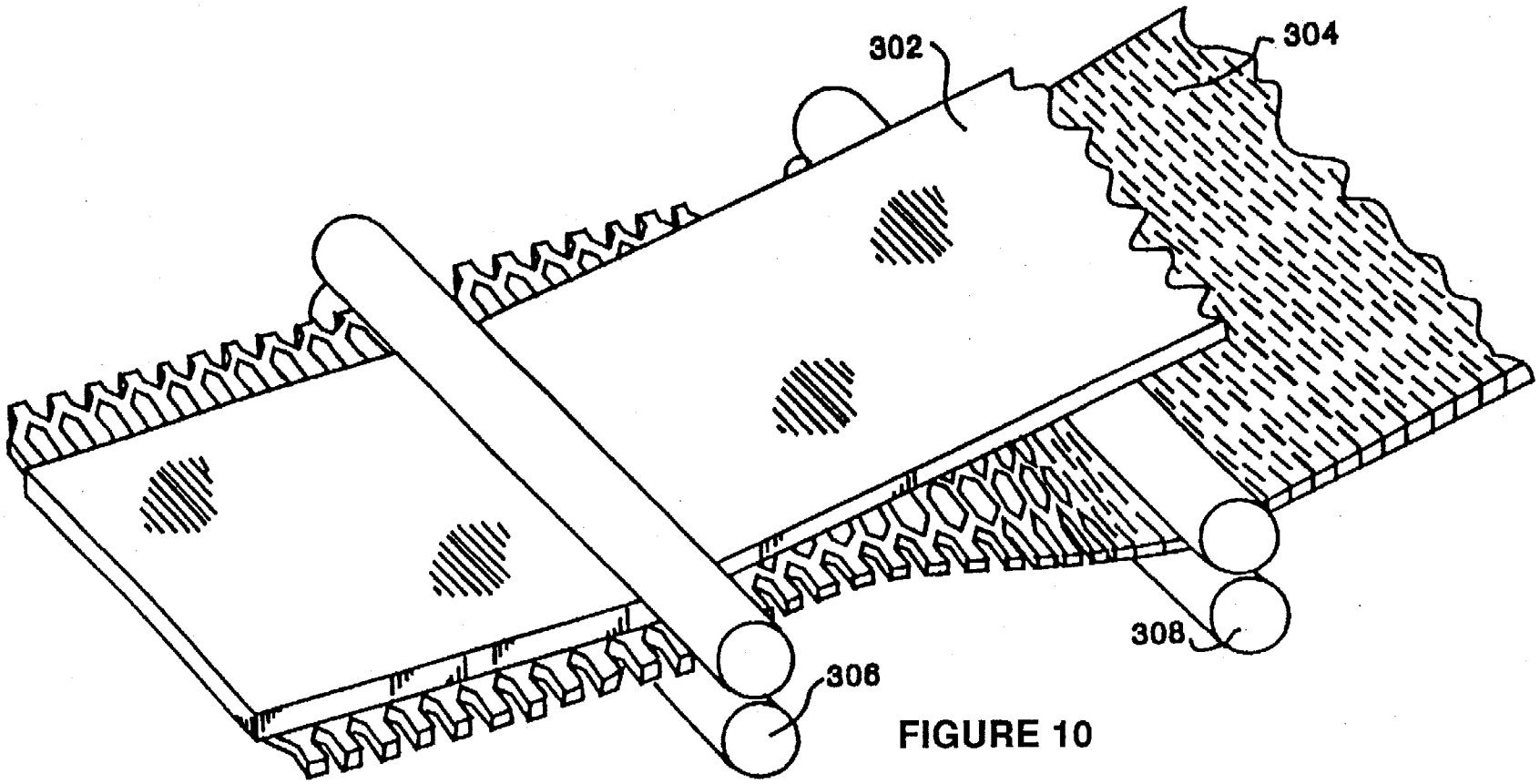
FIG. 10 is a perspective view of a slit paper, separator paper combination.
Figure 11:
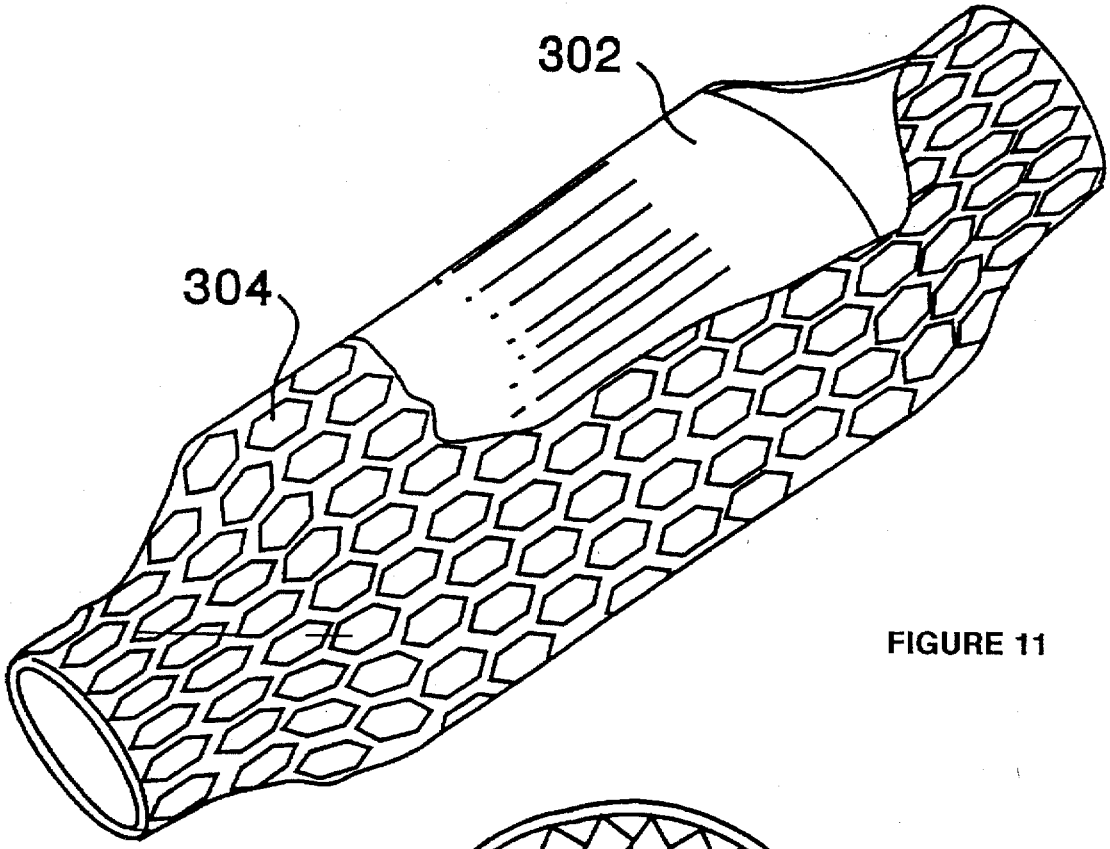
FIG. 11 is is a perspective view of an article wrapped in the combination of FIG. 10.

FIG. 10 illustrates the ratio between the separator sheet 302 and the expanded sheet 304 for use in wrapping bottles and the like. The separator sheet 302 preferably has a width less than that of the expanded sheet 304 to allow for the cells to interlock when wrapped about an article as shown in FIG. 11. Thus, in the case of a twenty inch wide roll, the separator sheet should be in the range from about twelve to sixteen inches wide. The composite is wrapped around an article which is typically narrower than the expanded paper. The article is centered in the wrapped leaving expanded sheet material at the ends. The end regions of the expanded sheet will retract to a substantially less expanded state and interlock with adjacent, exposed layers of expanded sheet material. Where the article is wider than the paper, the wrapping starts with the article inwardly of one edge of the paper and the composite is wrapped with a spiral action progressing toward the other side, until composite overhangs both sides of the article. The final product is similar to that achieved where the article is narrower than the composite. By allowing for the cells to interlock, the use of tape or other means to secure the wrap around the article is eliminated. FIG. 10 also illustrates how the paper is expanded between the guide rollers 308 and the expansion rollers 306. In the expansion process of FIG. 10, only the slit paper 304 is fed off the roll (not shown) through the guide rollers 308. The separator paper 302 is brought in from another roll (not shown) and fed only through the expansion rollers 306. This method eliminates separator sheet 302 from being exposed to the pulling force which expands the slit paper 304. Thus the need for any type of slit pattern in the separator paper 302 is eliminated. Additionally, an expander can contain a second sheet of slit paper (not shown) that can be fed through its own set of guide rollers into the expansion rollers 306, thereby producing a multi-layer combination having a separator sheet 302 sandwiched between two expanded sheets 304. In the event two expanded sheets are used, the separator sheet 302 can have the same width as the expanded sheet 304. Other combinations of separator sheets and expanded sheets can be used, as disclosed heretofore, with each expanded sheet having its own set of guide rollers.

Figure 12:
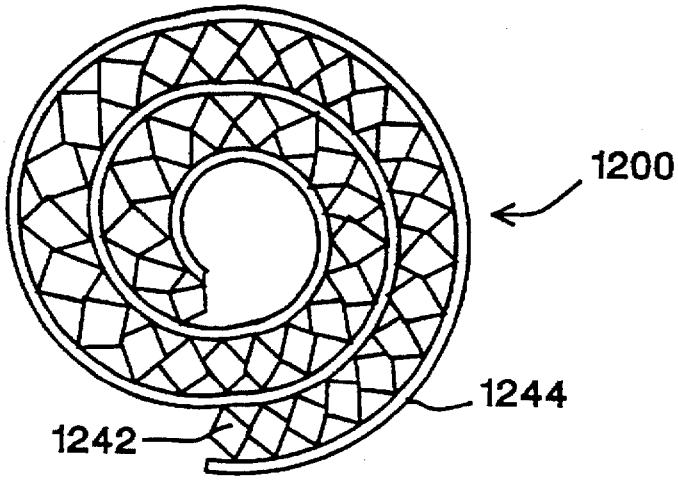
FIG. 12 is a end view of expanded and separator paper rolled into a cylinder.

To form a cylinder from the multi-layer combination, the slit paper is expanded in combination with a separator paper, as disclosed heretofore, and rolled into a cylindrical spiral. As disclosed, as the paper is expanded, it forms raised cells which, when rolled, interlock with cells in adjacent layers of slit paper 1242 as the paper spirals outward. The use of a separator sheet 1244 prevents the cells from interlocking with one another, thereby limiting locking to adjacent expanded sheets. The spiral cylinder 1200 of FIG. 12 is an illustration of an end view showing the expanded paper 1242 in combination with the separator sheet 1244. By combining the separator sheet 1244 with the expanded sheet 1242, the cylinder 1200 has substantially greater bulk than cylinders made from only a single sheet of expanded paper. The tighter the cylinder is wound, the greater the amount of sheet material required to form a cylinder. Although the tighter the cylinder, the firmer the cushion effect which is achieved, winding the cylinder too tightly will have the effect of removing air from the cylinders and lessening their cushioning qualities. Hence, winding forces on the slit paper material and the quantity of slit paper material used to produce a cylinder are critical. Furthermore, the cylinders can be customized to meet specific system requirements. The cylinder 1200 requires the use of tape to maintain the cylinder 1200 closed. By incorporating the separator sheet 1244, and eliminating the locking ability, the cylinder 1200 is incapable of self-locking.

Figure 13:
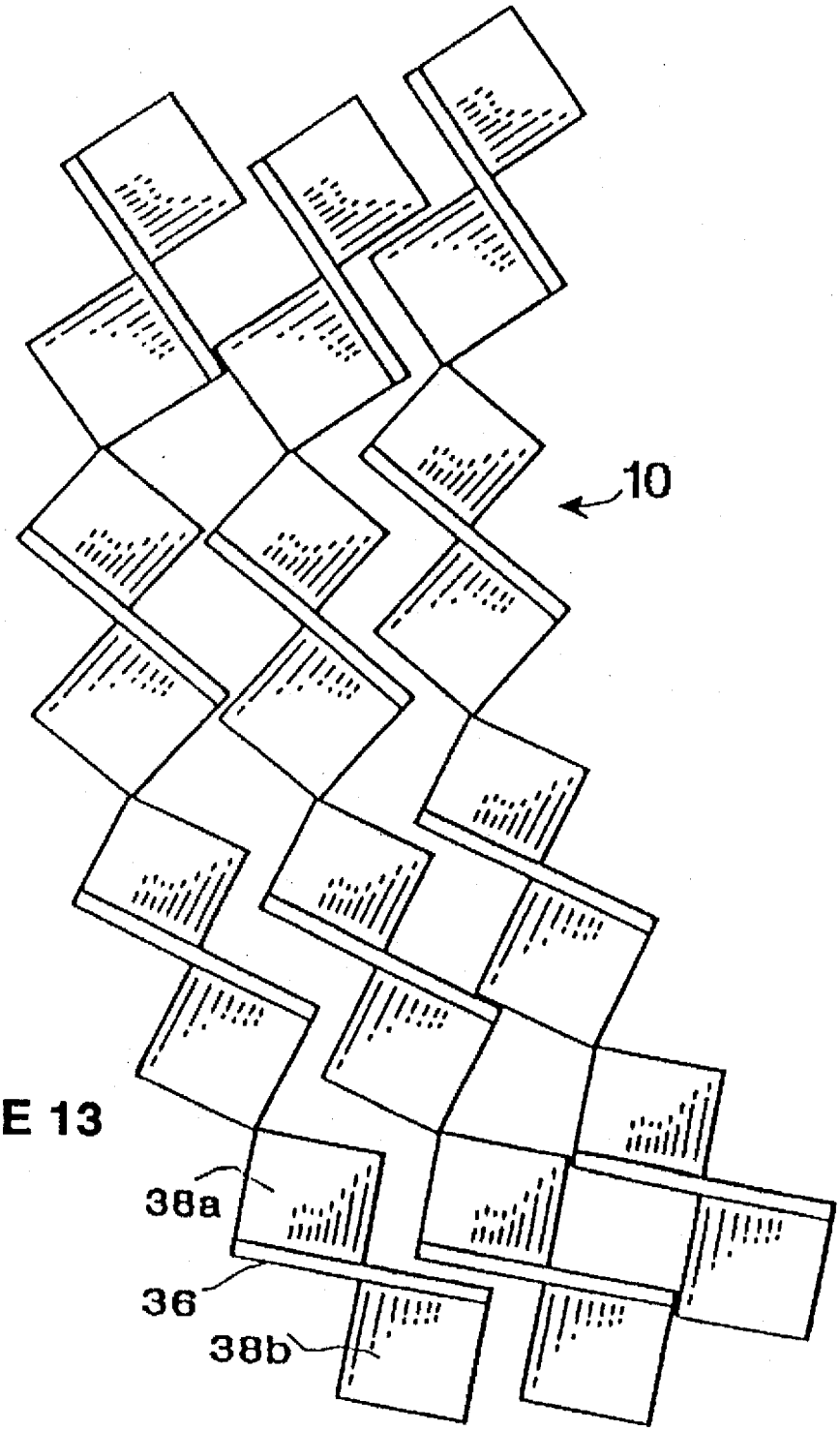
FIG. 13 is a view of expanded packing material illustrating nesting.

In FIG. 13, an conceptual view of nesting layers of expanded material is illustrated, depicting the cells of adjacent layers nesting. Although the actual cells cannot be seen i the side view of this Figure, the material forming the cell is depicted. The row spacing 538*a* and 538*b* and the slit spacing 536 are wapred, thereby forming the peaks and valleys which inerlock with one another. When the filling material is wrapped around an article, or around itself, it is in the form of a plurality of layers of interlocked expanded sheets due to the land areas of adjacent sheets of the layers of sheets nesting and interlocking with each other. Contraction of the expanded sheets is thus prevented or at least restricted.

The length of the slit and the ratio of the land intervals between slit affects the dimensions of the polygons which are formed during the expansion step. The higher the ratio of slit length to interval length the greater the maximum angle which can be formed between the plane of the sheet and the planes of the land areas. The greater the uniformity of the shape and size of the formed polygonal shaped open areas and the angle to which the land areas incline relative to the flat sheet, the greater the degree to which interlocking of land areas can be achieved. Interlocking of land areas, that is, the nesting of layers of sheets, reduces the effective thickness of the sheets. However, the net effect is still a dramatic increase in effective sheet thickness. For example, 0.008 inch thick paper having a slit pattern of a ½" slit, 3/16" slit spacing, and ⅛" row spacing, produces a ¼" by 3/16" land which can expand to under about one quarter of an inch thickness and will have a net effective thickness for two layers, when nested, of about 0.375 inches. It is noted that the land width is double the width of the legs. The net effect is a useful volumetric expansion of roughly at least 20 times the unexpanded volume of the paper.

The nesting of adjacent layers can occur to an excessive extent, as for example, where absolute uniformity of expansion exists in adjacent layers, and the adjacent layers merge or commingle with each other to a second layer adds to the combined thickness of two sheets only to the extent of the unexpanded thickness of the second sheet rather than the expanded thickness of the second sheet. Stated another way, where merging takes place rather than limited nesting, the cumulative effect of the addition of successive layers of sheets is based on a thickness increase relative to the unexpanded thickness of each successive sheet. The desired net effect is a nesting where the land of one layer drops into the cell of the adjacent layer only to the extent necessary to provide interlocking, that is, preclude relative motion of the layers. The overall object is to prevent slippage between adjacent layers, while maximizing the cumulative thickness of the layered material. Thus, on the one hand, the adjacent layers should interlock while on the other hand the adjacent layers should not interlock in order to maximize the thickness of the expanded, multi-layered product.

Figure 14:
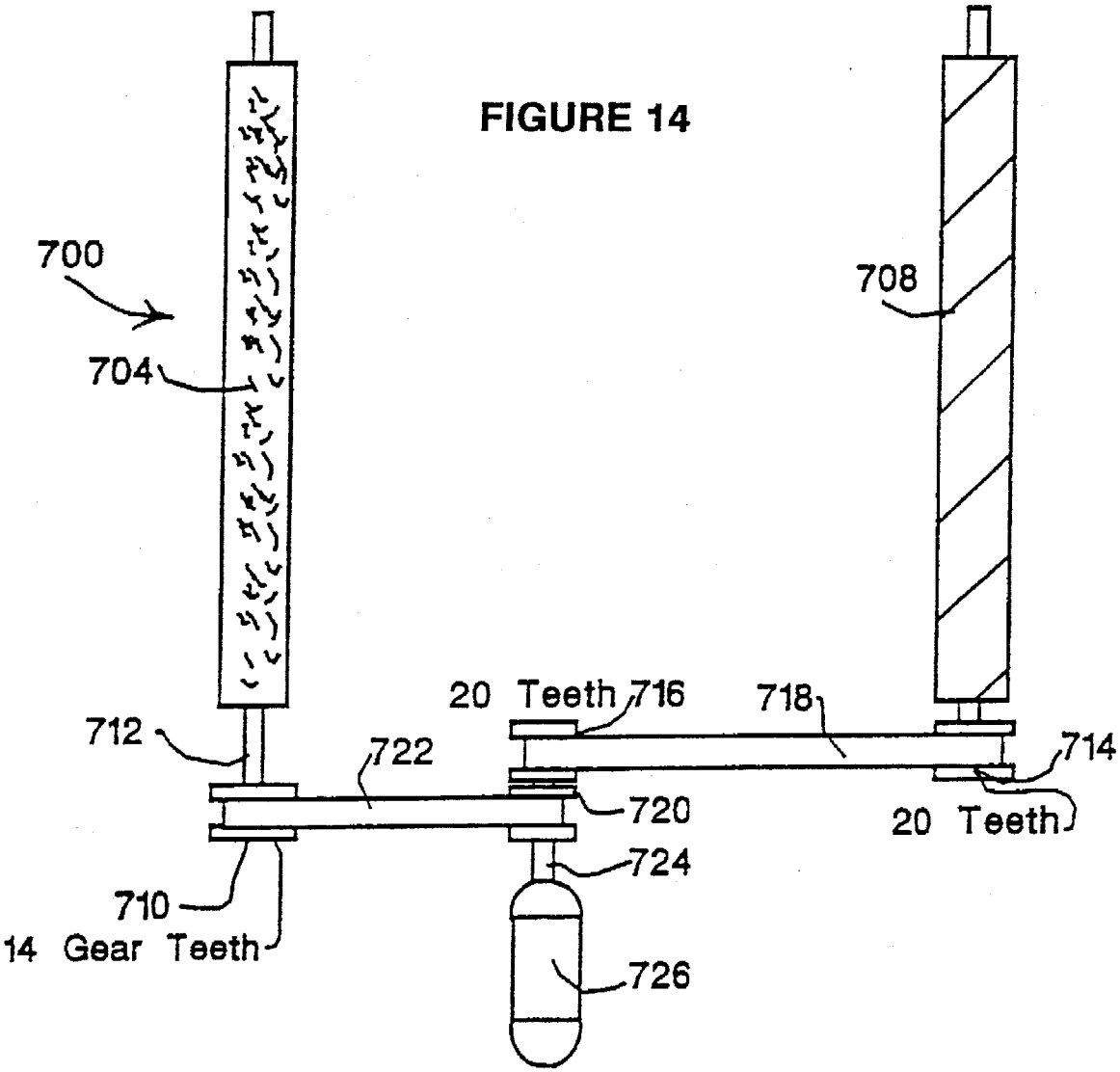
FIG. 14 is a plan view to the expansion machine of the instant invention.
Figure 15:
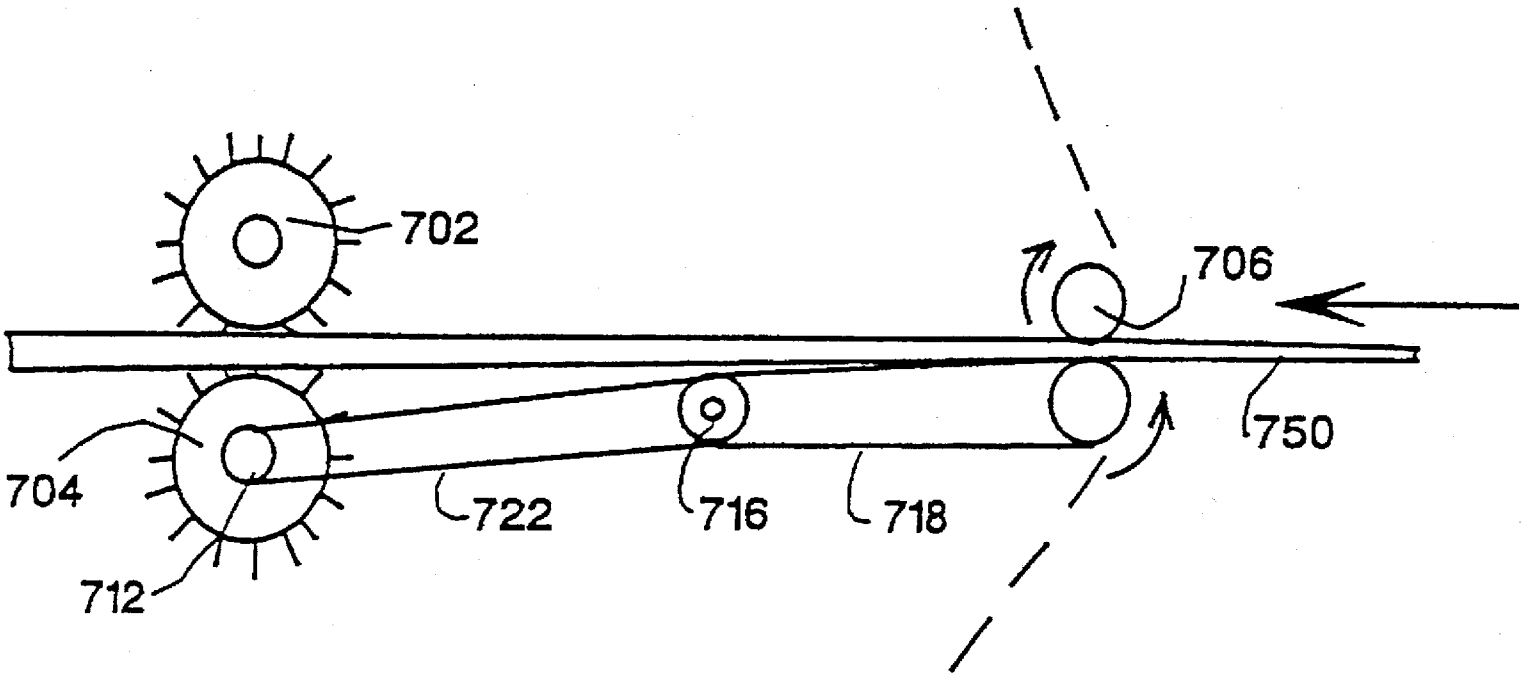
FIG. 15 is a side view of the paper positioning in conjunction with the expansion machine of FIG. 14.

FIGS. 14 and 15 illustrate in more detail the expansion portion 700 of the expanders which rapidly produce optimum expansion of the slit paper 750. The paper is fed from a storage roll, not shown, to the upper and lower drive rollers 706 and 708, where it is placed between the rollers 706 and 708. Both the upper drive roller 706 and the lower drive roller 708 are covered with a friction material, such as shrink tubular material made of a heat shrinkable polymer, as for example polyvinyl chloride. Alternatively, a rubber spray or painted coating can be used. Additionally, vinyl tape covered rollers and rubber rollers can be used. Abrasive coatings tend to produce some scratching of the paper and formation of dust due to the action of the abrasive material on the paper.

There is no theoretical upper limit to the amount of friction caused by the roller fiction covering, except that damage to the paper must be avoided. Therefore, the use of a coarse material is to be avoided.

The tension between the drive rollers and the expansion rollers must be sufficient to open, or expand the slit paper, but not sufficient to tear the paper. Typically, with a 30 pound paper, 2.5 oz. of force per linear inch, can be applied and with 70 pound paper, 5 oz. of force can be applied. The expansion should be sufficient to not only expand the paper, but also to crack some of the fibers, thereby decreasing the tendency of the paper to return to its unexpanded form.

The lower drive roller 708 is driven by the motor 726 through the rotation of the motor gear 716 and drive gear 714. The rotation created by the motor 726 is transmitted along motor shaft 724 to the motor gear 716 where it drives the drive belt 718, which in turn rotates the drive gear 714. The motor gear 720, also connected to the motor shaft 724, drives the expansion belt 722, which in turn rotates the expansion gear 710. Due to the spacing of the motor gear 716 and the motor gear 720 along the motor shaft 724, an expansion shaft 712 is generally provided between the expansion gear 710 and the upper expansion roller 702 and lower expansion roller 704. The drive gear 714 is provided with 20 teeth as compared to the expansion gear 710 which has 14 teeth. The difference in the number of teeth changes the rotation speed of the upper expansion roller 702 and lower expansion roller 704 as compared to the upper drive roller 706 and lower drive roller 708, allowing the motor shaft 724 to rotate at a single speed. The differential can be obtained by a number of methods known in the prior art and the foregoing is not intended to limit the scope of the invention. The speed differential between the upper and lower expansion rollers 702 and 704 and the upper and lower drive rollers 706 and 708 is critical as it provides the expansion of the slit paper 750. The slit paper 750 is being removed from the expansion machine 700 faster than it is entering, thereby forcing the slit paper 750 to expand. The speed differential between the expansion rollers 702 and 704 and the drive rollers 706 and 708 must be calculated to provide the required amount of expansion based on the weight of paper and end use.

In the gear assembly as illustrated in FIGS. 14 and 15, the expansion gear 710 and drive gear 714 can be changed to provide an increase or decrease in the speed differential. Other methods of changing the speed differential can be obtained and are known in the prior art.

The spacing of the expansion rollers is a distance of about 6 inches from the drive rollers 706 and 708 produce some binding in the middle of the paper, apparently due to the contraction of the paper which coincides with the expansion of the paper in thickness and length. A space between the expansion and drive rollers of about 11.25 inches works well for 19.5 inch rolled paper. With 3 inch wide paper, a minimum of 4 inches of separation between the roller sets is desired. The distance between the drive rollers and the expansion rollers varies proportionally with the width of the unexpanded paper.

The expansion device can be used to produce the composite expanded product by either feeding the unslit sheet with the expanded sheet through the expansion rollers, or by separately feeding the unslit sheet and combining it with the expanded sheet, downstream of the expansion rollers. Breaking at the end of the delivery provides for the user to be able to tear the desired length of paper from the roll of paper. Alternatively, a cutting blade can be used to sever the delivered quantity of paper from the remainder of the roll.

The upper expansion roller 702 and the lower expansion roller 704 are covered with a material which provides the effect of fingers. The covering must grip the unopened slit paper 750, without ripping the paper, and pull it open through use of the differential speed between the expansion rollers 702 and 704 and the driver rollers 706 and 708. The use of soft rubber covered rollers works to produce even expansion over the width of the paper. However, deformation of the paper can be experienced, in the form of crushed cells. That is, at the point of contact with the pair of expansion rollers, the expanded cells can be crushed by the rollers. The use of open cell and light foam can work to provide the required expansion. However, low density, open cell foam have a life span which is shorter than optimally desired, when in contact with expanded paper, due to the rigidity of the expanded cells. The foam or friction rollers can be used where the roller is in contact with an outer layer of unslit paper.

The preferred material is a nylon hook fiber of the type found in hook and loop fasteners of the type sold under the trademark VELCRO. The use of a set of rollers faced with hook ended fibers provide the required expansion without distortion of the expanded paper or deterioration of the rollers. Unlike, relatively firm foam covered rollers, the hook fibers did not crush the expanded cells as they pass between the expansion rollers. It should be understood the role of the expansion rollers is critical in that they must be able to grip and pull the paper so as to impart a speed of travel to the paper which is greater than the speed of the paper when it passes through the drive rollers. This requirement is in conflict with the need to permit the expanded paper to pass between the rollers without the expanded cells being crushed.

Figure 16:
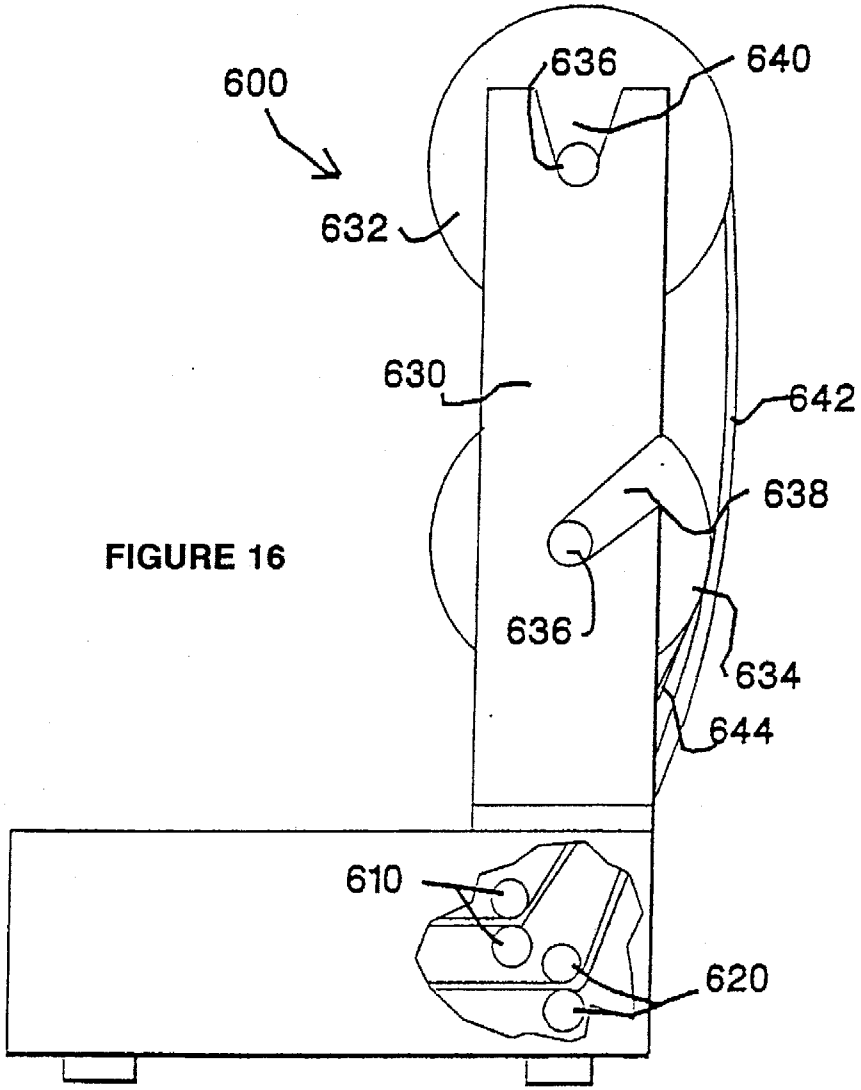
FIG. 16 is a fragmented illustration of a two roll delivery system using guide wheels.

An alternate to the the foregoing expanders is illustrated in FIG. 16. The multi roll expander 600 operates on the same basis as the expansion device 700. The expander 600 is provided with a paper support unit 630 which is provided with at least one retaining area 638 to receive the paper roll 634. The retaining area 638, as illustrated herein, is a notched portion which receives a bar 636 which is placed through the core of the paper roll 634. The expander 600, as illustrated, holds two rolls of paper 632 and 634 in retaining areas 638 and 640, however additional rolls can be added and any combination of expanded paper and separator sheets can be used. The paper 642 from roll 632 is fed into the bottom roller set 620 and the paper 644 from roll 634 is fed into the top roller set 610. The top roller set 610 and bottom roller set 620 are each designed as described in FIGS. 14 and 15.

Figure 17:
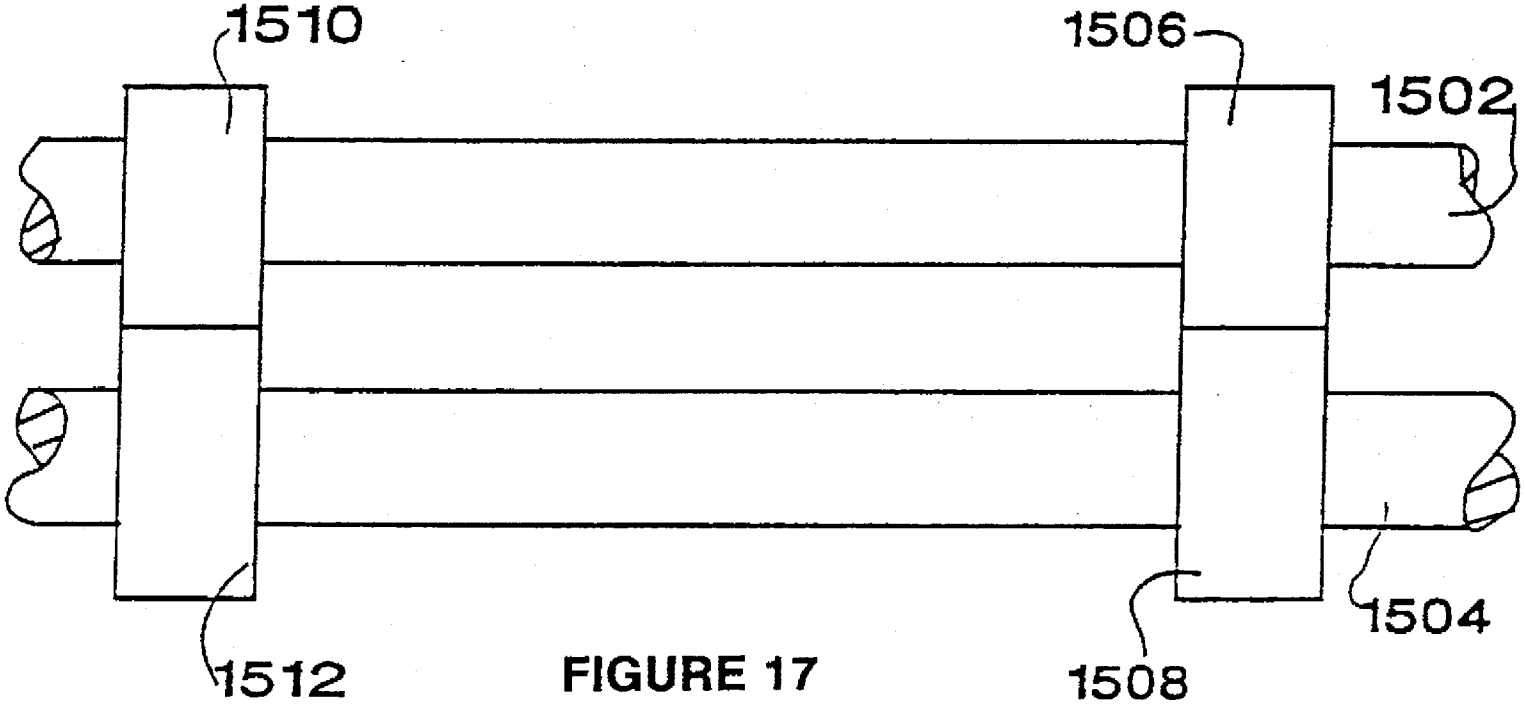
FIG. 17 is a front fragmentary view of the expansion rollers.

In the embodiment of FIG. 17, a pair of expansion rollers 1502 and 1504 are illustrated. The pair expansion rollers 1502 and 1504 are provided with a pair of rigid gripping wheels 1506, 1510 and 1508, 1512, respectively. The rigid wheels 1506, 1510, 1508 and 1512 are somewhat greater in diameter than the expansion rollers 1502 and 1504 and serve to grip the paper and draw it through. In the case of paper which expands to a thickness of one quarter of an inch, the difference between the diameter of rollers 1502 and 1504 and the wheels 1506, 1510 and 1508, 1512 must be greater than one quarter inch in order to avoid crushing the expanded paper. The contact must be between the paper and the small rigid wheels 1506, 1510 and 1508, 1512 to carry. The paper limits the amount of expanded material which is contacted and therefore crushed. The wheels 1506, 1510, 1508 and 1512 can be formed of rubber or any of the materials disclosed for use with the expander rolls. The width of the wheels 1506, 1510 and 1508, 1512 is as small as feasible to limit the amount of expanded paper which is crushed. The wheels 1506, 1510 and 1508, 1512 leave an elongated path or region of crushed cells along the length of the paper. Preferably, the wheels are about one half inch wide. Wider wheels provide greater gripping power but crush a greater amount of expanded cells. The amount of material crushed is equal to the width of the wheels times the number of wheels. The number of wheels is not narrowly critical but, the use of too few wheels will produce uneven drawing of the sheet material. At least two wheels are required, but three wheels evenly spaced along the expansion rollers produce more consistent and even drawing of the paper. Since the wheels must be in opposed pairs, too narrow a width produces a risk that the opposed wheels will be out of alignment and fail to provide a gripping force. The minimum width of the wheels is controlled by the ability to keep the wheels in proper gripping alignment. The maximum width of the wheels is limited by need to minimize crushing of the expanded material. In the instance of a 20 inch wide paper, the use of four half inch wheels, crushes 10 percent of the paper. The combined width of the rollers multiplied by the number of rollers, must be less than 20% of the width of the expanded paper, and preferably should be less than 10% of the expanded width. Most preferably, the combined width is no more than 5% of the expanded paper width.

In the embodiment of FIGS. 18 and 19, the Velcro® type hook filament material 1606, 1608 and 1610, 1612, respectively, is spiral wound around the expansion rollers 1602 and 1604, illustrating two of the possible patterns. Once expanded the hook filaments 1606 and 1608 have a great drawing power and is not necessary to have the entire roll covered. In fact, using less than full coverage can be advantageous. Where the hook filament material 1606 an 1608 is spiral wound around each expansion roll, contact with the expanded material is continuous, but the expanded sheet material is compressed between opposed hook material intermittently and only over a limited region. In this manner the paper is compressed during the start up of the expansion cycle, and once expanded the paper is drawn primarily on one surface unopposed by material. Thus, crushing of expanded paper is minimized or eliminated.

In the embodiment of FIG. 18, the spiral of the hook filament material 1606 on the first roller 1602 is opposite from the spiral direction of the filament material 1608 on the second roller 1604. In this manner the hook filament material of the first expansion roller 1602 is always opposed by the corresponding material of the second expansion roller 1604. Preferably, as shown in FIG. 18, the filament material spirals 1610 and 1612 are in the same direction. In this manner, the two spirals 1610 and 1612 are only in opposition, or contact, periodically. In this manner, the paper is compressed between opposing spirals, as required to start the expansion process. Once expanded contact between the spirals 1610 and 1612 and the expanded paper is predominantly one side unopposed, thereby eliminating or minimizing the problem of crushing of multiple layers of expanded cells, of multiple layers of while providing periodic high compression needed for the startup of the expansion cycle.

Surprisingly, multilayers of expanded sheets can be pulled through the expansion rollers with sufficient force to produce the required expansion and without crushing of the cells, even when the expanded sheets are separated by a nesting prevention, separator sheet. The system was found to work even where the expanded sheet is sandwiched between unslit sheets which are in contact with the expansion rollers.

The expansion rollers can be provided with a solenoid or a pair of solenoids, one at each end. The solenoid is provided with a timer which raises the top roller slightly once the expansion is achieved, so that maximum start up compression is available to initiate the expansion, but minimal compression occurs after the expansion has been achieved so as to avoid crushing of the expanded cells. This is possible, due to the interaction between the hooks and the inclines of the expanded material. The hooks grab the paper and it is not necessary to force the paper against the hooks by means of an opposing roller. Light contact between the hooks and the expanded material is sufficient to draw the sheet of expanded paper and maintain the expansion operation. Once the rotation of the rollers has ceased, the solenoid releases the top roller to come in contact with the bottom roller. The amount of displacement of the rollers for a slit sheet having one eight inch slit row spacing, is about three sixteenths of an inch for each layer of expanded material. The displacement can be adjusted as required, to adjust to different slit row spacing and can be adjusted downwardly to compensate for nesting or upwardly to compensate for the use of a separator sheet.

Whereas hexagonal cells are preferred for the expansion sheets, oval cells are preferred for the separator sheet. The rigidity of the hexagonal cells facilitates nesting, even where the cells of adjacent layers are of substantially unequal size, or the incline pattern is rotated 45 or 90 degrees. Oval cells, however, will flatten readily, thus collapsing rather than nesting. It should be apparent, that the novel use of dissimilar layers, provides a wide range of potential cushioning characteristics for the composite structure. The degree of thickening, or loft can be varied, as well as the stiffness, and the relationship between deflection and load. The response to high impact, as measured by G-force test equipment can be customized through the selection of the combination of slit patterns, total absence of slits for the separator sheets and weights of the expansion sheets and separator sheets.

The variables are as follows:

1 Paper weight for expansion sheet
2 Paper weight for separator sheet
3 Slit pattern for expansion sheet
  A—Absence of slit pattern
  B—Perforated to provide discrete sections
  C—Slit to provide expansion equal to expansion sheet
  a—Slits periodic to provide expansion
  b—Slits uniform, but of different pattern from expansion sheet to preclude nesting.
4 Ratio of number of expansion sheets to separator sheets.
5 Number of expansion sheets nested with an adjacent expansion sheet.

The system thus provides customization comparable to that which is attainable with cellular foam plastics. In plastics the cell size and product density can be selected in order to regulate cushioning characteristics. Also, different plastics, such as urethane, vinyl and styrenes have different cushioning characteristics. It is now possible, to provide similar cushioning customization previously available only with cellular foam plastics, with paper, through the use of a composite expanded sheet product.

The compression characteristics of the multi-layer structure differs from that of multiple layers of single-ply expanded wrap. Whereas the single-ply material nests and adjacent lands and legs are supported, in a cascade fashion, by an adjacent lands or legs, the separator sheet distributes load or impact from cells of one layer to proximate cells of the adjacent layer. That is, in a nested relationship, a pair, or series of lands are in an essentially parallel, slightly offset relationship, with lands of alternate layers separated only by lands of intermediate layers. Whereas in a nested relationship, lands can be in supporting relationship with one or more lands of adjacent layers, the multi-layer structure distributes load through the separator sheet which prevents nesting. Thus, with the separator sheet, impact forces or loads are transmitted from cell to cell of adjacent layers from layer to layer, rather than from land to land. Obviously, the same is true for the nested legs.

The multi-layer, separator sheet structure's stiffness and resiliency results in it's being exceptionally suited for use with lighter weight paper than it's single-ply counterpart, thereby increasing the volume yield per pound and reducing the price per cubic foot. A greater amount of energy is required to collapse the multi-ply structure than is required to collapse the single ply counterpart.

The structures can take the following forms:

A—A single layer of expanded slit sheet material with a single layer of a separator sheet;
B—separator sheet is narrower than necked down width of expanded slit sheet;
C—separator sheet has spaced apart tear lines;
D—separator sheet is manually fed, unrestricted;
E—separator sheet has expansion slits is able to permit expansion equal to that of expanded sheet;
F—separator sheet is slit, but with a longer slit than slits of expanded slit sheet and greater space between rows of slits, to provide fewer cells, but larger cells than in the expanded sheet;

G—single layer sheet of thin, flexible material such as tissue, with expanded material to keep all layers of expanded material from nesting;

H—pairs of expanded sheet separated by separator sheet;

I—separator sheet between expanded sheet and outer unslit sheets;

J—separator sheet between expanded sheet and outer unslit sheets folded and sealed into envelope form;

K—a plurality of pairs of expanded sheet separated by separator sheet, where each set of pairs is separated by a separator sheet;

L—single layer expanded sheet and single layer separator sheet rolled into cylinder form, as a void fill, either end glued and/or separator sheet is narrower than expanded sheet;

M—pair of expanded sheets separated by separator sheet and rolled into cylinder form for use as void fill; or N—expanded sheet preferably with hexagonal cells for optimum rigidity.

The cushioning properties of expanded slit sheets of paper is more complex than might be appreciated at first glance. The use of hexagonal cells uniquely provides a stronger cell structure than oval cells. Unlike oval cells, hexagonal cells have the lands supported by the inflexible legs. It is this inflexibility of the legs which produces the hexagonal shape of the cells. Under load, the legs of the hexagonal cells resist the movement of the lands and transmit the load to associated lands which in turn transmit load to associated legs. Finally, the legs crush at the juncture of the lands. In oval cells, the legs twist and crush. The nesting action of cells, provides for adjacent legs to support each other. Where the separator is used, the nesting action is precluded from taking place. The force transmission is then transmitted from one layer to regions of the next layer. This provides a great performance improvement for oval cells. While hexagonal cells provide the optimum use of the strength of the paper and out performs oval cells, where separator sheets are used, oval cells performance is raised to more acceptable levels.

The measurement of the performance of various configurations can be on the basis of single layers under load, multiple layers under load and multiple layer under impact conditions, using a G-force test. Each test measures different characteristics of performance.

Since other modifications and changes varied to fit particular operating requirements and environments will be apparent to those skilled in the art, the invention is not considered limited to the example chosen for the purposes of disclosure, and covers all changes and modifications which do not constitute departures from the true spirit and scope of this invention.

What is claimed is:

1. A paper cushion wrap comprising a combination of at least one sheet of slit expanded sheet material and a layer of substantially unexpanded sheet material, adjacent layers of expanded sheet material being separated by said substantially unexpanded sheet material, said expanded sheet having rows of cells with semi-rigid peaks, said semi-rigid peaks having an incline such that cells of adjacent layers can nest and interlock, said peaks being prevented from nesting in cells and interlocking with adjacent layers of expanded sheet material by said separator sheet.

2. The paper cushion wrap of claim 1, wherein said substantially unexpanded sheet material is tissue paper, said slit sheets material is at least forty pound kraft paper, and wherein said combination is folded flat in a flag fold to form a triangular cushioning element, in which each layer is essentially flat and the direction of said rows of cells are offset by about 90 degrees each fold and adjacent layers of expanded sheet material are separated by a layer of tissue paper.

3. The paper cushion wrap of claim 1, wherein the width of said separator sheet is substantially less than the width of said expanded sheet material when fully expanded, thereby forming two outer regions in which the expanded sheet material extends beyond said separator sheets, and in said two outer regions, adjacent layers of expanded sheet materials are in contact in a nesting and interlocking engagement.

4. The paper cushion wrap of claim 3, further comprising an article within said paper cushioning wrap, wherein said article is fully contained within and enclosed by said combination in a manner such that said outer regions extend beyond said article, said outer region which extends beyond the article being contracted and necked down, due to the contraction force of said expanded sheet material, said outer regions have an inner perimeter and said article having an outer perimeter, said outer region inner perimeter being substantially lees than said outer perimeter of said article, thereby containing said article.

5. The paper cushion wrap of claim 3, wherein said paper cushion wrap is in the form of a spiral and said separator sheet is a light weight sheet material no greater than forty pound paper.

6. The paper cushion wrap of claim 1, wherein said slit expanded sheet is formed from a slit pattern which produces a cell wall incline of about 60 degrees.

7. The paper cushion wrap of claim 2, wherein said slit expanded sheet is formed from a slit pattern which forms hexagonal cells.

8. The paper cushion wrap of claim 1, wherein said separator sheet is a light weight sheet material no greater than forty pound paper.

9. The paper cushion wrap of claim 8, wherein said separator sheet is tissue paper.

10. The paper cushion wrap of claim 9, wherein said expanded sheet material is at least forty pound kraft paper.

11. The paper cushion wrap of claim 10, wherein said expanded sheet material is about 70 pound kraft paper.

12. The paper cushion wrap of claim 1, wherein said slit expanded sheet is formed from a slit pattern which produces a cell wall having an incline produced by a slit pattern of one half inch slit, 3/16 slit spacing and 1/8 inch row spacing.

13. The paper cushion wrap of claim 12, wherein said separator sheet is is a light weight sheet material no greater than forty pound paper, and said cushion wrap is in the form of a spiral.

14. A paper cushioning pad comprising a combination of two outer layers of unexpanded sheet material at least two inner layers of slit expanded sheet material, and a light weight separator sheet between two layers of expanded sheet material, said expanded sheet having cells with semi-rigid peaks, said semi-rigid peaks having an incline such that cells of adjacent layers can nest and interlock, said peaks being prevented from nesting in cells and interlocking with adjacent layers of expanded sheet material by said separator sheet at least said two outer layers of unexpanded sheet material being sealed to each other in a longitudinal line along two opposing edges, to form an integrated structure.

15. The paper cushioning pad of claim 14, wherein said pad is folded over to form an envelope, having a folded edge and an open end opposite said folded end, the remaining two edges being sealed together.

16. The paper cushion wrap of claim 14, wherein said slit sheets material is at least forty pound kraft paper and has hexagonal cells.

17. The paper cushion wrap of claim 14, wherein said slit expanded sheet is formed from a slit pattern which produces a cell wall incline of about 60 degrees, and said separator sheet is tissue paper.

18. The paper cushion wrap of claim 14, wherein said slit expanded sheet is formed from a slit pattern which forms hexagonal cells and said separator sheet is a light weight sheet material no greater than forty pound paper.

19. The paper cushion wrap of claim 18, wherein said separator sheet is tissue paper.

20. The paper cushion wrap of claim 19, wherein said expanded sheet material is at least forty pound kraft paper.

21. The paper cushion wrap of claim 20, wherein said expanded sheet material is about 70 pound kraft paper.

22. The paper cushion wrap of claim 14, wherein said slit expanded sheet is formed from a slit pattern which produces a cell wall having an incline produced by a slit pattern of one half inch slit, 3/16 slit spacing and 1/8 inch row spacing, and wherein said separator sheet is tissue paper.

23. The paper cushion wrap of claim 22, wherein said separator sheet is about 30 pound paper.

* * * * *